US011396438B2

(12) United States Patent
Ueno et al.

(10) Patent No.: US 11,396,438 B2
(45) Date of Patent: Jul. 26, 2022

(54) MEDIUM TRANSPORT DEVICE AND MEDIUM PROCESSING APPARATUS

(71) Applicant: SEIKO EPSON CORPORATION, Tokyo (JP)

(72) Inventors: Kohei Ueno, Matsumoto (JP); Nobuyuki Mizushima, Shiojiri (JP); Yutaro Harada, Shiojiri (JP); Shunpei Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 332 days.

(21) Appl. No.: 16/696,897

(22) Filed: Nov. 26, 2019

(65) Prior Publication Data

US 2020/0172363 A1 Jun. 4, 2020

(30) Foreign Application Priority Data

Nov. 30, 2018 (JP) ..... JP2018-225108

(51) Int. Cl.
*B65H 31/34* (2006.01)
*B65H 37/04* (2006.01)
(Continued)

(52) U.S. Cl.
CPC ..... *B65H 31/34* (2013.01); *B65H 9/004* (2013.01); *B65H 29/48* (2013.01); *B65H 31/02* (2013.01); *B65H 31/36* (2013.01); *B65H 37/04* (2013.01); *B65H 45/18* (2013.01); *B65H 2301/4212* (2013.01); *B65H 2301/4213* (2013.01); *B65H 2301/51611* (2013.01); *B65H 2404/1114* (2013.01); *B65H 2405/11152* (2013.01); *B65H 2511/152* (2013.01); *B65H 2511/30* (2013.01);
(Continued)

(58) Field of Classification Search
CPC ..... B65H 31/34; B65H 31/36; B65H 9/004; B65H 2301/4213; B65H 2404/1114; B65H 2301/4223; B65H 37/04; B65H 29/48
See application file for complete search history.

(56) References Cited

U.S. PATENT DOCUMENTS 7,489,898 B2 2/2009 Hayashi
10,071,874 B2 * 9/2018 Taki ..... B65H 37/04
(Continued)

FOREIGN PATENT DOCUMENTS

CN 108529269 9/2018
JP 2009-249107 10/2009
(Continued)

*Primary Examiner* — Jeremy R Severson
(74) *Attorney, Agent, or Firm* — Workman Nydegger

(57) ABSTRACT

A medium transport device includes a feeding unit that transports a medium, a stack portion that receives the medium transported by the feeding unit between a support surface for supporting the medium in an inclined posture in which a downstream side in a transport direction is directed downward and an opposing surface opposing the support surface and stacks the medium, an alignment portion that aligns a downstream end of the medium stacked in the stack portion, a paddle that is provided between the feeding unit and the alignment portion in the transport direction and moves the medium toward the alignment portion by rotating while being in contact with the medium, and a control unit that controls an operation of the paddle, in which the control unit controls the operation of the paddle according to a condition.

18 Claims, 11 Drawing Sheets

(51) Int. Cl.

| | |
|---|---|
| ***B65H 9/00*** | (2006.01) |
| ***B65H 29/48*** | (2006.01) |
| ***B65H 31/36*** | (2006.01) |
| ***B65H 45/18*** | (2006.01) |
| ***B65H 31/02*** | (2006.01) |

(52) U.S. Cl.
CPC .... *B65H 2513/11* (2013.01); *B65H 2513/512* (2013.01); *B65H 2515/112* (2013.01); *B65H 2515/40* (2013.01); *B65H 2515/805* (2013.01); *B65H 2801/27* (2013.01)

(56) References Cited

U.S. PATENT DOCUMENTS

| | | | |
|---|---|---|---|
| 10,479,636 | B2 | 11/2019 | Nakano |
| 2018/0251331 | A1 | 9/2018 | Nakano |

FOREIGN PATENT DOCUMENTS

| | | |
|---|---|---|
| JP | 2010-001149 | 1/2010 |
| JP | 2010-143678 | 7/2010 |
| JP | 2010-195523 | 9/2010 |

* cited by examiner

MEDIUM TRANSPORT DEVICE AND MEDIUM PROCESSING APPARATUS

The present application is based on, and claims priority from JP Application Serial Number 2018-225108, filed Nov. 30, 2018, the disclosure of which is hereby incorporated by reference herein in its entirety.

BACKGROUND

1. Technical Field

The present disclosure relates to a medium transport device for transporting a medium, and a medium processing apparatus including the medium transport device.

2. Related Art

Among medium processing apparatuses that perform predetermined processing on a medium, there is one configured to be capable of forming a booklet by performing saddle-stitching processing in which the center of a plurality of sheets of stacked media in the width direction is bound and then performing folding processing in which the media is folded at a binding position.

Such a medium processing apparatus may be incorporated into a recording system which can execute continuously from recording on the medium by a recording device represented by an ink jet printer to the saddle-stitching processing and folding processing of the recorded medium.

Among the medium processing apparatuses, there is one configured to transport the medium before processing to a stack portion by a medium transport device and to perform the saddle-stitching processing after allowing an end portion of the medium mounted on the stack portion to be abutted against the alignment portion and to be aligned.

As an example, JP-A-2010-001149 discloses a medium processing apparatus including a stack portion, an alignment portion that aligns an end portion of the medium mounted on the stack portion, a paddle that rotates while being in contact with the medium and moves the medium toward the alignment portion. In JP-A-2010-001149, the stack portion is a compile tray 441, the alignment portion is an end guide 443, and the paddle is a paddle 52.

In the medium processing apparatus described in JP-A-2010-001149, the paddle assists abutment of the end portion of the medium against the alignment portion, and thus the medium can be reliably aligned.

However, depending on a type or state of the medium, for example, the medium moved by rotation of the paddle vigorously hits the alignment portion and is bounced off the alignment portion, or conversely, the medium does not reach the alignment portion, which may result in inappropriate alignment.

SUMMARY

According to an aspect of the present disclosure, there is provided a medium transport device including a feeding unit that transports a medium, a stack portion that receives the medium transported by the feeding unit between a support surface for supporting the medium in an inclined posture in which a downstream side in a transport direction is directed downward and an opposing surface opposing the support surface and stacks the medium, an alignment portion that aligns a downstream end of the medium stacked in the stack portion, a paddle that is provided between the feeding unit and the alignment portion in the transport direction and moves the medium toward the alignment portion by rotating while being in contact with the medium, and a control unit that controls an operation of the paddle, in which the control unit controls the operation of the paddle according to a condition.

DESCRIPTION OF EXEMPLARY EMBODIMENTS

Figure 1:
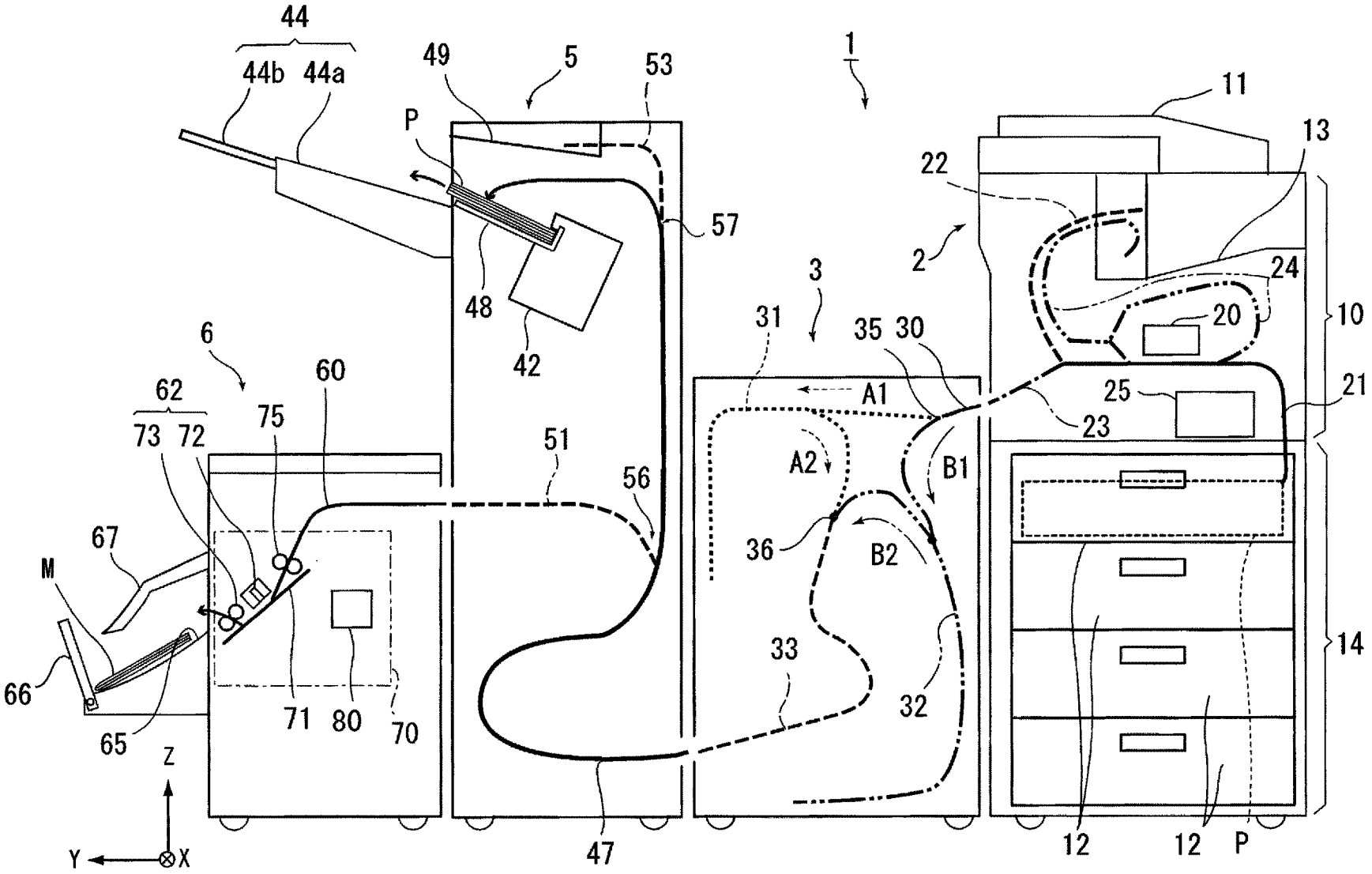
FIG. 1 is a schematic view of a recording system.

Hereinafter, the present disclosure will be schematically described.

According to a first aspect of the present disclosure, there is provided a medium transport device including a feeding unit that transports a medium, a stack portion that receives the medium transported by the feeding unit between a support surface for supporting the medium in an inclined posture in which a downstream side in a transport direction is directed downward and an opposing surface opposing the support surface and stacks the medium, an alignment portion that aligns a downstream end of the medium stacked in the stack portion, a paddle that is provided between the feeding unit and the alignment portion in the transport direction and moves the medium toward the alignment portion by rotating while being in contact with the medium, and a control unit that controls an operation of the paddle, in which the control unit controls the operation of the paddle according to a condition.

According to the first aspect, the downstream end can be aligned by allowing the medium to be appropriately abutted against the alignment portion according to the condition.

A second aspect of the present disclosure provides the medium transport device according to the first aspect, in which, as the condition, any of a type of the medium to be stacked, the number of stacked media previously stacked in the stack portion, a stack height of the media previously stacked in the stack portion, and a discharge amount of liquid to the medium when the medium transported by the feeding unit is a recorded medium to which the liquid is discharged for recording may be used.

According to the second aspect, the operation of the paddle can be controlled using, as the condition, any of the type of the medium to be stacked, the number of stacked media previously stacked in the stack portion, the stack height of the medium previously stacked in the stack portion, and the discharge amount of liquid to the medium when the medium transported by the feeding unit is the recorded medium to which the liquid is discharged for recording, and the downstream end can be aligned by allowing the downstream end to be appropriately abutted against the alignment portion.

A third aspect of the present disclosure provides the medium transport device according to the first aspect, in which the control unit may control the operation of the paddle according to a basis weight of the medium.

A fourth aspect of the present disclosure provides the medium transport device according to the first aspect, in which the control unit may use a plurality of conditions as the condition.

According to the fourth aspect, since the control unit uses the plurality of conditions as the condition, the control unit can control the operation of the paddle more appropriately to align the downstream end by allowing the downstream end to be abutted against the alignment portion.

A fifth aspect of the present disclosure provides the medium transport device according to the fourth aspect, in which the plurality of conditions may include two or more of a type of the medium to be stacked, a temperature in an installation environment of the device, a humidity in the installation environment, the number of stacked media previously stacked in the stack portion, and the discharge amount of liquid to the medium when the medium transported by the feeding unit is a recorded medium to which the liquid is discharged for recording.

According to the fifth aspect, the operation of the paddle can be controlled more appropriately based on two or more of the plurality of conditions to align the downstream end by allowing the downstream end to be abutted against the alignment portion.

A sixth aspect of the present disclosure provides the medium transport device according to any of the first to fifth aspects, in which the control unit may change a rotation speed of the paddle according to the condition.

According to the sixth aspect, since the control unit changes the rotation speed of the paddle according to the condition, the medium can be more appropriately abutted against the alignment portion.

A seventh aspect of the present disclosure provides the medium transport device according to any of the first to sixth aspects, in which the control unit may switch between driving and stopping of the paddle according to the condition.

According to the seventh aspect, since the control unit switches driving and stopping of the paddle according to the condition, the medium can be more appropriately abutted against the alignment portion.

An eighth aspect of the present disclosure provides the medium transport device according to the second aspect, in which the control unit may change a rotation start timing of the paddle according to the condition.

A ninth aspect of the present disclosure provides the medium transport device according to the fifth aspect, in which the control unit may use the type of the medium and the number of stacked media previously stacked in the stack portion as the plurality of conditions, stop the paddle in stacking the medium when the number of stacked media is less than a predetermined threshold value according to the type of the medium, and drive the paddle in stacking the medium when the number of stacked media is equal to or greater than the predetermined threshold value according to the type of the medium.

Since the stack portion stacks the medium in the inclined posture in which the downstream side in the transport direction is directed downward, when the number of stacked media previously stacked in the stack portion is small, the medium is easy to move toward the alignment portion by its own weight. For that reason, when the paddle is rotated in a state where the number of stacked media is small, there is a possibility that the medium vigorously hits the alignment portion and is bounced off the alignment portion or the medium is not appropriately aligned.

When the number of stacked media increases and a space between the top medium and the opposing surface narrows, frictional resistance between the top medium and a subsequent medium to be sent next to the stack portion is likely to occur, and the subsequent medium is difficult to move toward the alignment portion by its own weight.

The number of stacked media that makes it difficult for the medium to move toward the alignment portion by its own weight changes depending on the type of the medium.

According to the ninth aspect, the control unit uses the type of the medium and the number of stacked media in the stack portion as the plurality of conditions, stops the paddle in stacking the medium when the number of stacked media is less than the predetermined threshold value according to the type of the medium, and thus the possibility that the medium vigorously hits the alignment portion can be reduced when the number of stacked media in the stack portion is small. The control unit drives the paddle in stacking the medium when the number of stacked media is equal to or greater than the predetermined threshold value according to the type of the medium, and thus the medium can be more reliably aligned by allowing the medium to be abutted against the alignment portion when the number of stacked media increases.

A tenth aspect of the present disclosure provides the medium transport device according to the fifth aspect, in which the control unit may use the discharge amount of the liquid to the medium and the number of stacked media in the stack portion as the plurality of conditions, stop the paddle in stacking the medium when the number of stacked media is less than a predetermined threshold value according to the discharge amount of the liquid to the medium, and drives the paddle in stacking the medium when the number of stacked media is equal to or greater than the predetermined threshold value according to the discharge amount of the liquid to the medium.

As described above, when the paddle is rotated in the state where the number of stacked media is small, there is a possibility that the medium vigorously hits the alignment portion and is bounced off the alignment portion or the media is not appropriately aligned. When the number of stacked media increases and a space between the top medium and the opposing surface narrows, frictional resistance between the top medium and a subsequent medium to be sent next to the stack portion is likely to occur, and the subsequent medium is difficult to move toward the alignment portion by its own weight.

Since the frictional resistance between the media changes according to the discharge amount of the liquid to the media, the number of stacked media that makes it difficult for the medium to move toward the alignment portion by its own weight changes according to the discharge amount of the liquid to the medium.

According to the tenth aspect, the control unit uses the discharge amount of the liquid to the medium and the number of stacked media in the stack portion as the plurality of conditions, stops the paddle in stacking the medium when the number of stacked media is less than the predetermined threshold value according to the discharge amount of the liquid to the medium, and thus the possibility that the medium vigorously hits the alignment portion and is bounced off the alignment portion can be reduced when the number of stacked media in the stack portion is small. The control unit drives the paddle in stacking the medium when the number of stacked media is equal to or greater than the predetermined threshold value according to the discharge amount of the liquid to the medium, and thus the medium can be more reliably aligned by allowing the medium to be abutted against the alignment portion when the number of stacked media increases.

An eleventh aspect of the present disclosure provides the medium transport device according to the tenth aspect, in which the threshold value of the number of stacked media may be set to be lower as the discharge amount of the liquid to the medium increases.

Since the frictional resistance between the media increases as the discharge amount of the liquid to the medium increases, even if the number of stacked media in the stack portion is small, the medium is difficult to move toward the alignment portion by its own weight.

According to the eleventh aspect, since the threshold value of the number of stacked media in the stack portion is set lower as the discharge amount of the liquid to the medium increases, a possibility of an abutment failure of the medium against the alignment portion can be avoided more reliably.

A twelfth aspect of the present disclosure provides the medium transport device according to the tenth aspect, in which the control unit may make a rotation speed of the paddle when the discharge amount of the liquid to the medium is a first discharge amount faster than the rotation speed when the discharge amount of the liquid to the medium is a second discharge amount smaller than the first discharge amount.

As the discharge amount of the liquid to the medium increases, the frictional resistance between the medium increases. According to the twelfth aspect, since the control unit makes the rotation speed of the paddle when the discharge amount of the liquid to the medium is the first discharge amount faster than the rotation speed when the discharge amount of the liquid to the medium is the second discharge amount smaller than the first discharge amount, movement of the medium by the paddle can be reliably performed when the discharge amount of the liquid to the medium is large and the frictional resistance between the media is large.

A thirteenth aspect of the present disclosure provides the medium transport device according to the tenth aspect, in which the control unit may set the threshold value according to a difference between the discharge amount of the liquid to a first surface of the medium and the discharge amount of the liquid to a second surface opposite to the first surface.

A fourteenth aspect of the present disclosure provides the medium transport device according to any one of the first to the thirteenth aspect, in which the control unit may drive the paddle after an upstream end of the stacked medium passes a position where the stacked medium receives a feeding force from the feeding unit.

According to the fourteenth aspect, since the control unit drives the paddle after the upstream end of the stacked medium passes the position where the medium to be stacked receives the feeding force from the feeding unit, the possibility of the medium being buckled between the feed roller pair and the paddle can be reduced.

A fifteenth aspect of the present disclosure provides the medium transport device according to any one of the first to thirteenth aspect, in which the feeding unit is a feed roller pair including a driving roller controlled to rotate by the control unit and a driven roller driven to rotate following the rotation of the driving roller, and the control unit makes a circumferential speed of the paddle faster than a circumferential speed of the driving roller.

According to the fifteenth aspect, since the control unit makes the circumferential speed of the paddle faster than the circumferential speed of the driving roller, the possibility of the medium being buckled between the feed roller pair and the paddle can be reduced.

A sixteenth aspect of the present disclosure provides the medium transport device according to any one of the first to fifteenth aspect, in which the paddle includes a first paddle provided on a rotation shaft intersecting the transport direction and second paddles provided on the rotation shaft and disposed on both sides of the first paddle, and the first paddle and the second paddles are disposed such that phases in a circumferential direction of a rotation shaft are different from each other.

According to a seventeenth aspect of the present disclosure, there is provided a medium processing apparatus including the medium transport device according to the first to sixteenth aspects and a processing unit that performs processing on the medium stacked in the stack portion.

According to the seventeenth aspect, the same function and effect as any of the first to sixteenth aspects can be obtained in the medium processing apparatus including the medium transport device according to the first to sixteenth aspects and the processing unit that performs processing on the medium stacked in the stack portion.

An eighteenth aspect of the present disclosure provides the medium processing apparatus according to the seventeenth aspect, in which the processing unit may include a binding unit that binds the medium and a folding unit that folds the medium at a binding position by the binding unit.

According to the eighteenth aspect, the same function and effect as the seventeenth aspect can be obtained in the medium processing apparatus in which the processing unit includes the binding unit that binds the medium and the folding unit that folds the medium at the binding position by the binding unit.

First Embodiment

Hereinafter, a first embodiment will be described with reference to the drawings. In the XYZ coordinate system illustrated in each drawing, the X-axis direction indicates an apparatus depth direction, the Y-axis direction indicates an apparatus width direction, and the Z-axis direction indicates an apparatus height direction.

Overview of Recording System

As an example, a recording system 1 illustrated in FIG. 1 includes a recording unit 2, an intermediate unit 3, a first unit 5, and a second unit 6 in order from the right to the left in FIG. 1. In this embodiment, the second unit 6 is a "medium processing apparatus" that performs saddle-stitching processing on a medium.

The recording unit 2 performs recording on the transported medium. The intermediate unit 3 receives a recorded medium from the recording unit 2 and delivers the medium to the first unit 5. The first unit 5 performs end-stitching processing to bundle received media and bind ends of the media, or passes the received medium as it is and delivers the received medium to the second unit 6. The second unit 6 includes a medium transport device 70 for transporting a medium, and performs saddle-stitching processing in which the center of the medium is bound and folded to form a booklet.

Hereinafter, description will be made in detail in order of the recording unit 2, the intermediate unit 3, the first unit 5, and the second unit 6 (medium processing apparatus).

About Recording Unit

The recording unit 2 will be described with reference to FIG. 1. The recording unit 2 is configured as a multifunction machine including a printer unit 10 having a line head 20 as a recording unit that performs recording on a medium, and a scanner unit 11. In this embodiment, the line head 20 is configured as a so-called ink jet recording head that performs recording by discharging ink, which is liquid, onto the medium.

Below the printer unit 10, a cassette storage unit 14 including a plurality of medium accommodation cassettes 12 is provided. The medium P accommodated in the medium accommodation cassette 12 is fed to a recording area by the line head 20 through a feeding path 21 indicated by a solid line in FIG. 1 and a recording operation is performed. The medium after being recording by the line head 20 is sent to a first discharge path 22 for discharging the medium to a discharge tray 13 for a recorded medium provided above the line head 20 or a second discharge path 23 for sending the medium to the intermediate unit 3.

In FIG. 1, the first discharge path 22 is indicated by a broken line, and the second discharge path 23 is indicated by a one-dot chain line. The second discharge path 23 extends in the +Y direction of the recording unit 2 and delivers the medium to a receiving path 30 of the adjacent intermediate unit 3.

The recording unit 2 is provided with a reversing path 24 indicated by a two-dot chain line in FIG. 1, and is configured to be capable of double-sided recording in which recording is performed on the second side of the medium by reversing the recorded medium on the first side of the medium. In each of the feeding path 21, the first discharge path 22, the second discharge path 23, and the reversing path 24, one or more pairs of transport rollers (not illustrated) are disposed as an example of a unit for transporting the medium.

The recording unit 2 is provided with a first control unit 25 that controls an operation related to transport and recording of the medium in the recording unit 2. The recording system 1 is configured such that the recording unit 2, the intermediate unit 3, the first unit 5, and the second unit 6 are mechanically and electrically connected to each other and the medium can be transported from the recording unit 2 to the second unit 6. The first control unit 25 can control various operations in the intermediate unit 3, the first unit 5, and the second unit 6 connected to the recording unit 2.

The recording system 1 is configured to be able to input settings in the recording unit 2, the intermediate unit 3, the first unit 5, and the second unit 6 from an operation panel (not illustrated). The operation panel can be provided in the recording unit 2 as an example.

About Intermediate Unit

The intermediate unit 3 will be described with reference to FIG. 1. The intermediate unit 3 illustrated in FIG. 1 delivers the medium received from the recording unit 2 to the first unit 5. The intermediate unit 3 is disposed between the recording unit 2 and the first unit 5. The medium transported through the second discharge path 23 of the recording unit 2 is received by the intermediate unit 3 from the receiving path 30 and transported toward the first unit 5. The receiving path 30 is indicated by a solid line in FIG. 1.

In the intermediate unit 3, there are two transport paths for transporting the medium. The first transport path is a path through which the medium is transported from the receiving path 30 to a joining path 33 through a first switchback path 31 indicated by a dotted line in FIG. 1. The second path is a path through which the medium is transported from the receiving path 30 to the joining path 33 through a second switchback path 32 indicated by a two-dot chain line in FIG. 1.

The first switchback path 31 is a path for switching back the medium in the arrow A2 direction after receiving the medium in the arrow A1 direction. The second switchback path 32 is a path for switching back the medium in the arrow B2 direction after receiving the medium in the arrow B1 direction.

The receiving path 30 branches into the first switchback path 31 and the second switchback path 32 at a branch portion 35. The branch portion 35 is provided with a flap (not illustrated) that switches a destination of the medium to either the first switchback path 31 or the second switchback path 32.

The first switchback path 31 and the second switchback path 32 join at a joining portion 36. Accordingly, even if the medium is sent from the receiving path 30 to either the first switchback path 31 or the second switchback path 32, the medium can be delivered to the first unit 5 through the common joining path 33.

The medium transported on the joining path 33 is delivered to the first transport path 47 of the first unit 5 from the +Y direction of the intermediate unit 3.

One or more pairs of the transport rollers (not illustrated) are disposed in each of the receiving path 30, the first switchback path 31, the second switchback path 32, and the joining path 33.

When recording is continuously performed on a plurality of media in the recording unit 2, the medium that has entered the intermediate unit 3 is alternately sent to the transport path passing through the first switchback path 31 and the transport path passing through the second switchback path 32. This can increase the throughput of medium transport in the intermediate unit 3.

In a case a configuration in which recording is performed by discharging ink (liquid) to the medium as in the line head 20 of this embodiment, if the medium is wet when processing is performed by the first unit 5 or the second unit 6 in a subsequent stage, a recording surface may be rubbed or consistency of the medium may be poor.

By delivering the recorded medium from the recording unit 2 to the first unit 5 through the intermediate unit 3, the transport time until the recorded medium is sent to the first unit 5 can be made long, and the medium can be further dried before reaching the first unit 5 or the second unit 6.

About First Unit

The first unit 5 will be described with reference to FIG. 1. The first unit 5 has a first transport path 47 connected to a first processing unit 42 that performs end-stitching processing, and a second transport path 51 that sends the received medium to the second unit 6 without passing through the first processing unit 42. The end-binding processing is, for example, processing for binding one corner of the medium or one side of the medium. The second transport path 51 branches from the first transport path 47 at the first branch portion 56.

The first unit 5 includes a first tray 44 that receives the medium after end-stitching processing discharged from the first unit 5. The first tray 44 is provided so as to protrude from the first unit 5 in the +Y direction. In this embodiment, the first tray 44 includes a base portion 44*a* and an extension portion 44*b*, and the extension portion 44*b* is configured to be storable in the base portion 44*a*.

In this embodiment, the first processing unit 42 is a stapler that performs end-binding processing in which a plurality of media are superposed and the end portion is bound. The first processing unit 42 may be configured to perform punching processing or the like for forming a hole at a predetermined position of the medium.

The medium received by the first unit 5 is transported on the first transport path 47 illustrated by the solid line in FIG. 1. The medium P transported on the first transport path 47 is sent to the processing tray 48, and is stacked on the processing tray 48 with the rear end in the transport direction aligned. When a predetermined number of media P are stacked on the processing tray 48, the first processing unit 42 performs end-stitching processing on the rear end of the medium P. The medium after end-stitching processing is discharged to the first tray 44 by a discharging unit (not illustrated).

To the first transport path 47, a third transport path 53 branched from the first transport path 47 at the second branch portion 57 downstream of the first branch portion 56 is connected. The third transport path 53 is a path for discharging the medium to an upper tray 49 provided above the first unit 5. In the upper tray 49, the medium not subjected to processing can be stacked.

In each of the first transport path 47, the second transport path 51, and the third transport path 53, one or more pairs of transport rollers (not illustrated) are disposed as an example of a unit for transporting the medium. Each of the first branch portion 56 and the second branch portion 57 is provided with a flap (not illustrated) for switching the destination of the medium.

About Second Unit

Subsequently, the second unit 6 will be described. The second unit 6 illustrated in FIG. 1 includes the medium transport device 70. The medium delivered from the second transport path 51 of the first unit 5 is transported on the transport path 60 illustrated by the solid line in FIG. 1 and is sent to a second processing unit 62.

In the second processing unit 62, after the medium is bound, the saddle-stitching processing can be performed to fold the medium at the binding position into a booklet. The saddle-stitching processing by the medium transport device 70 and the second processing unit 62 will be described in detail later.

A bundle of media after the saddle-stitching processing is discharged to a second tray 65 illustrated in FIG. 1. The second tray 65 includes a restriction portion 66 at the tip in the +Y direction, which is a medium discharge direction, and suppresses that the bundle of media discharged to the second tray 65 protrudes from the second tray 65 or falls from the second tray 65 in the medium discharge direction. Reference numeral 67 denotes a guide portion 67 for guiding the bundle of media M discharged from the second unit 6 to the second tray 65.

About Medium Transport Device

The medium transport device 70 will be described with reference to FIGS. 1 to 3. The medium transport device 70 illustrated in FIG. 2 includes a feed roller pair 75 as a feeding unit for transporting the medium P, a stack portion 71 for stacking the medium P, and the alignment portion 76 for aligning a downstream end E1 (FIG. 3) of the medium P stacked in the stack portion 71, a paddle 81, and a control unit 80 (FIG. 1). The feed roller pair 75 includes a driving roller 75*a* and a driven roller 75*b* that is driven to rotate by rotation of the driving roller 75*a*, and the driving roller 75*a* is controlled by the control unit 80 to rotate.

Figure 2:
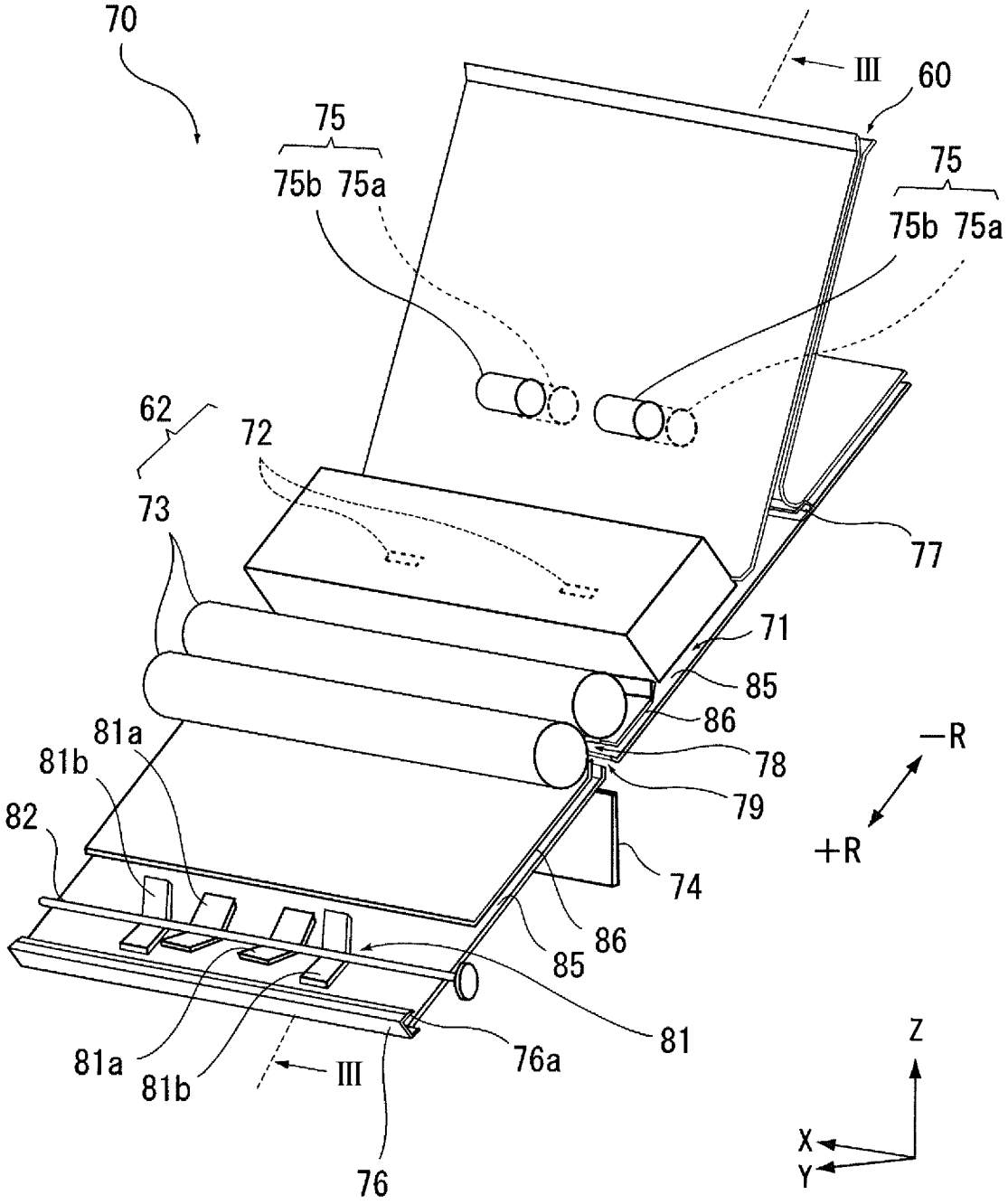
FIG. 2 is a schematic perspective view of a medium transport device.

In FIG. 2, the stack portion 71 receives and stacks the medium P transported by the feed roller pair 75 between a support surface 85 for supporting the medium in an inclined posture in which a downstream side in a transport direction +R is directed downward and an opposing surface 86 opposing the support surface 85. The paddle 81 is provided between the feed roller pair 75 and an alignment portion 76 in the transport direction +R, and moves the medium P toward the alignment portion 76 by rotating while being in contact with the medium P. The control unit 80 (FIG. 1) controls the operation of the medium transport device 70 including the paddle 81 and the driving roller 75*a*.

Figure 3:
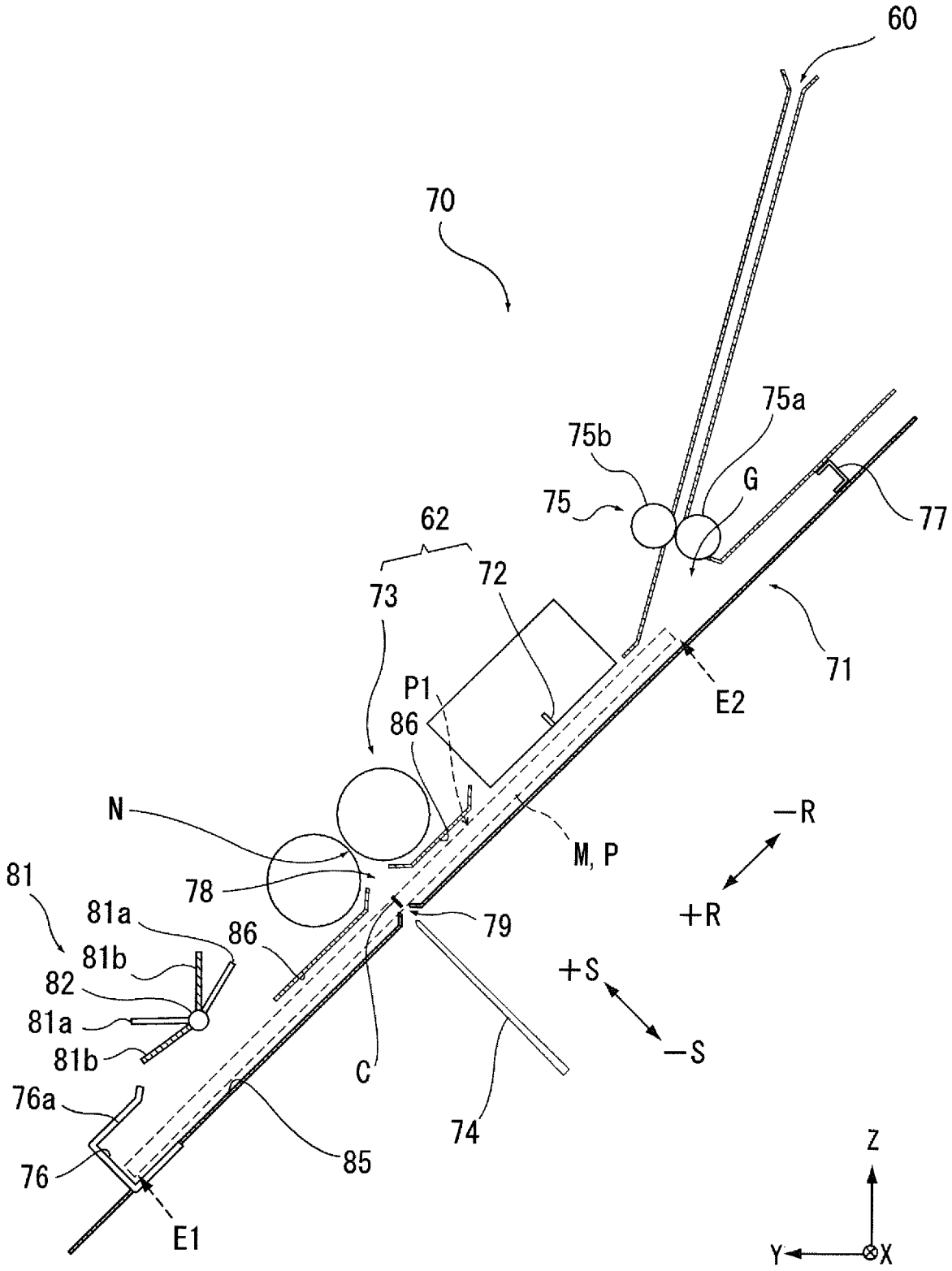
FIG. 3 is a cross-sectional view taken along the III-III arrow in FIG. 2.

As illustrated in FIG. 3, the second processing unit 62, which is a processing unit that performs processing on the medium P stacked in the stack portion 71 of the second unit 6 (medium processing apparatus), includes a binding unit 72 for binding the bundle of media M consisting of a plurality of media P stacked in the stack portion 71 at a binding position, and a folding roller pair 73 as a folding unit for folding the bundle of media M at the binding position.

In FIG. 3, the reference numeral G indicates a joining position G where the transport path 60 and the stack portion 71 join. The binding position in this embodiment is the central portion C in the transport direction +R of the medium P stacked in the stack portion 71. The medium P is sent from the transport path 60 to the stack portion 71 by the feed roller pair 75.

In the stack portion 71, the alignment portion 76 capable of abutting on the downstream end E1 of the transport direction +R of the medium P stacked in the stack portion 71, and an abutment portion 77 capable of abutting on an upstream end E2 of the transport direction +R of the medium P stacked in the stack portion 71 are provided.

The alignment portion 76 and the abutment portion 77 are configured to be movable in both the transport direction +R of the medium P in the stack portion 71 and a reverse direction −R thereof illustrated in FIG. 3. The alignment portion 76 and the abutment portion 77 can be moved in the transport direction +R and the reverse direction −R, for example, using a rack and pinion mechanism, a belt moving mechanism, or the like operated by the power of a drive source (not illustrated). The alignment portion 76 is configured to be movable also in the S-axis direction which intersects the transport direction +R in FIG. 3. The movement of the alignment portion 76 will be described in detail when a stack operation in the stack portion 71 is described.

The alignment portion 76 includes an eaves portion 76*a* facing a downstream end region K close to the downstream end E1 of the medium P stacked in the stack portion 71.

A binding unit 72 for binding the bundle of media M stacked in the stack portion 71 at a predetermined position in the transport direction +R is provided downstream of the joining position G. The binding unit 72 is a stapler as an example. In this embodiment, as illustrated in FIG. 2, a plurality of binding units 72 are provided at intervals in the X-axis direction which is the width direction of the medium.

As described above, the binding unit 72 is configured to bind the bundle of media M with the central portion C of the bundle of media M as the binding position in the transport direction +R.

A folding roller pair 73 is provided downstream of the binding unit 72. The opposing surface 86 is open at a position corresponding to a nip position N of the folding roller pair 73, and an approach path 78 of the bundle of media M from the stack portion 71 to the folding roller pair 73 is formed. At the entrance of the approach path 78 of the opposing surface 86, slopes are formed which guide the central portion C, which is the binding position, from the stack portion 71 to the nip position N.

Figure 7:
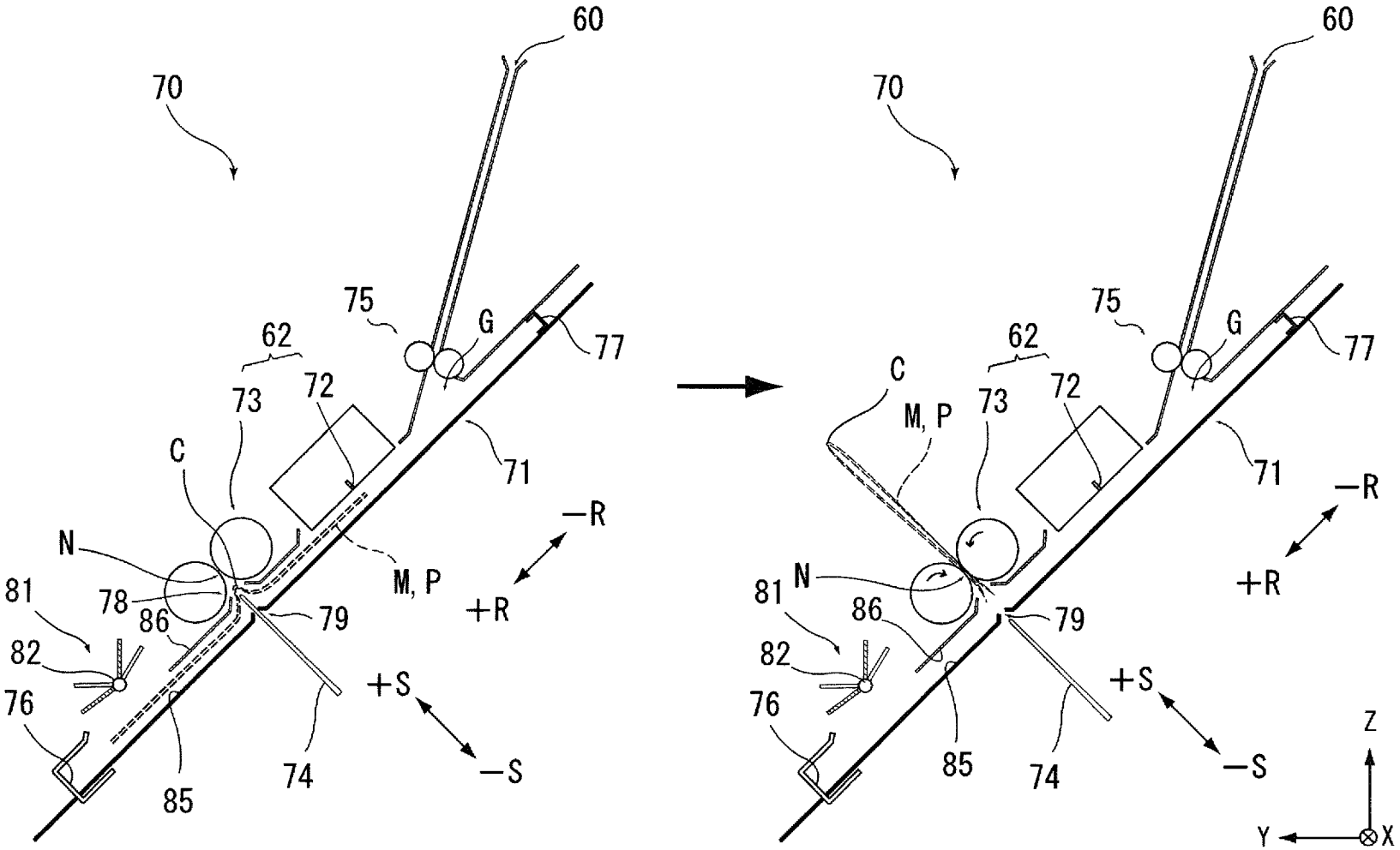
FIG. 7 is another diagram for explaining the flow of medium transport in the medium transport device.

A blade 74, which is capable of switching between a retreated state retreated from the stack portion 71 as illustrated in FIG. 3 and an advanced state advanced to the binding position of the bundle of media M stacked in the stack portion 71 as illustrated in the left diagram of FIG. 7, is provided on the opposite side of the folding roller pair 73 with the stack portion 71 interposed therebetween. Reference numeral 79 denotes a hole 79 provided in the support surface 85, and the blade 74 can pass through the hole 79.

About medium transport during saddle-stitching processing Next, with reference to FIGS. 4 to 7, a basic flow from transporting the medium P to saddle stitching and discharging the medium P in the medium transport device 70 will be described.

Figure 4:
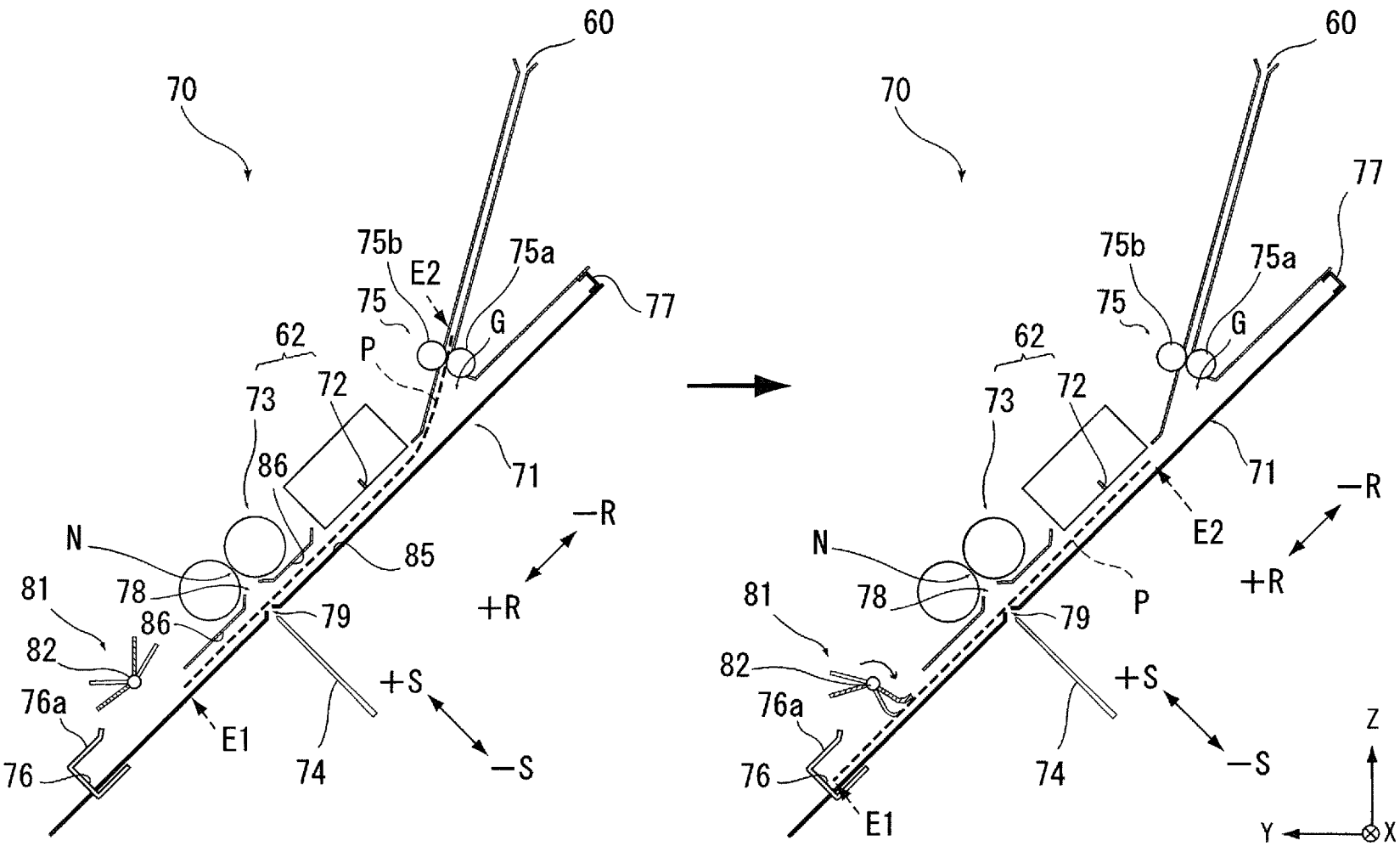
FIG. 4 is a diagram for explaining a flow of medium transport in the medium transport device.

First, as illustrated in the left diagram of FIG. 4, the medium P is transported from the transport path 60 toward the stack portion 71. The medium P is transported from the transport path 60 to the stack portion 71 by the feed roller pair 75. While the medium P is being sent to the stack portion 71 by the feed roller pair 75, the paddle 81 retreats from the stack portion 71.

As illustrated in the right diagram of FIG. 4, when the upstream end E2 of the medium P comes out of the nip of the feed roller pair 75, the medium P moves toward the alignment portion 76 by its own weight and the paddle 81 provided upstream of the alignment portion 76 is rotated to abut the medium P toward the alignment portion 76.

The operation of the paddle 81 is controlled by the control unit 80 according to the conditions as described later. The control of the paddle 81 by the control unit 80 will be described in detail after the flow of transport of the medium P in the medium transport device 70 is generally described.

In the left diagram of FIG. 4, the alignment portion 76 is disposed such that the distance from the joining position G of the transport path 60 and the stack portion 71 to the alignment portion 76 is longer than the length of the medium P. With this configuration, as illustrated in the right diagram of FIG. 4, the medium P is received by the stack portion 71 without the upstream end E2 of the medium P transported from the transport path 60 remaining in the transport path 60. The position of the alignment portion 76 in the transport direction +R of the stack portion 71 can be changed according to a size of the medium P.

When the paddle 81 is rotated by a predetermined number of rotations so that the medium P abuts against the alignment portion 76, the paddle 81 is stopped in a state of being retreated from the stack portion 71. The alignment portion 76 is displaced in the −S direction as illustrated in the left diagram of FIG. 5 and the eaves portion 76*a* presses the medium P toward the support surface 85, and then, the alignment portion 76 is displaced in the +S direction to return to the original position, and prepares to receive the next medium P.

Figure 5:
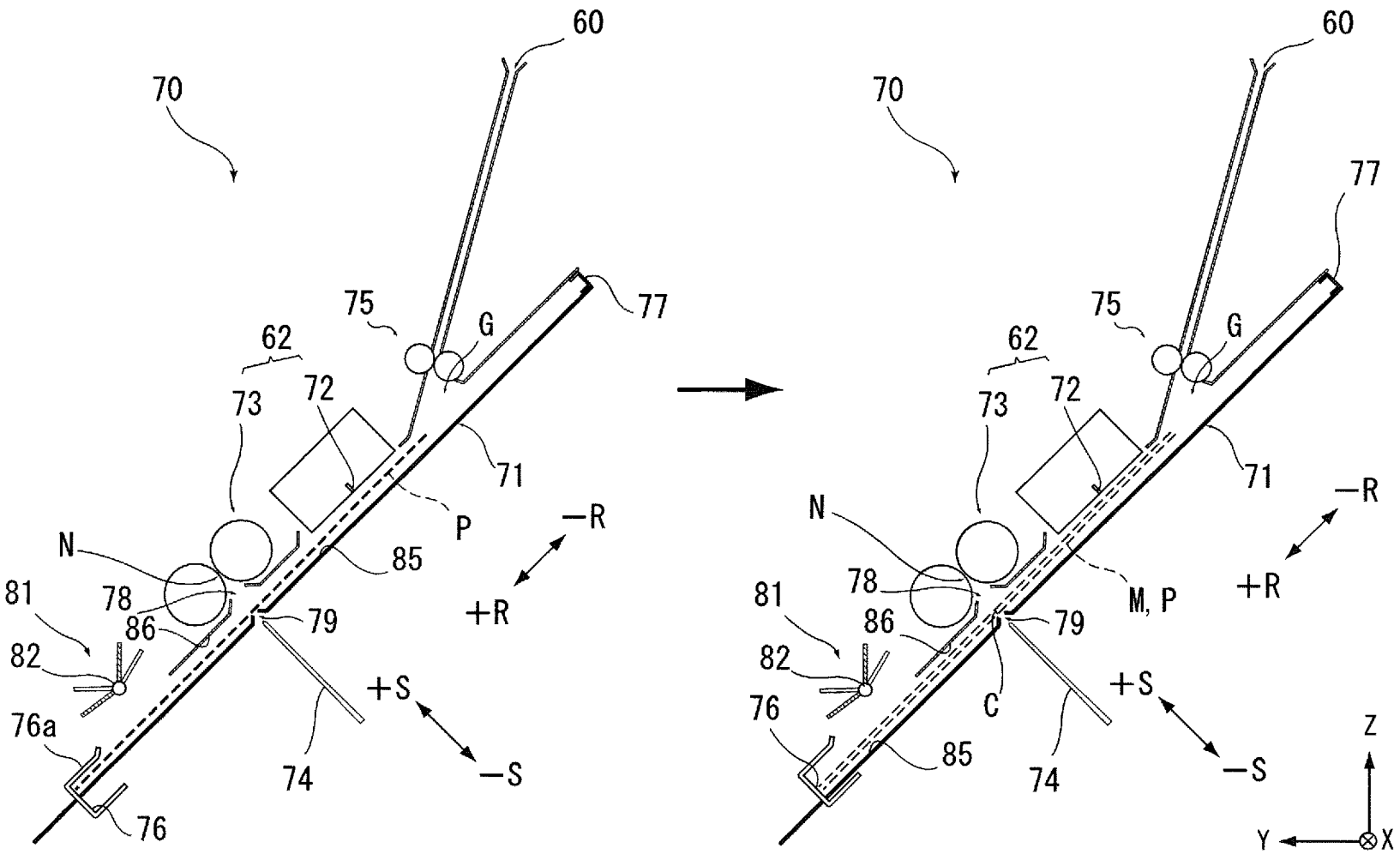
FIG. 5 is another diagram for explaining the flow of medium transport in the medium transport device.

The operations from the left diagram of FIG. 4 to the left diagram of FIG. 5 are repeated, and a plurality of media P are stacked in the stack portion 71 in a state where the downstream end E1 is aligned with the alignment portion 76. The right diagram of FIG. 5 illustrates a state in which the plurality of media P are stacked in the stack portion 71. A bundle of media P is referred to as a bundle of media M.

When a predetermined number of media P are stacked in the stack portion 71, the binding unit 72 performs binding processing in which the central portion C in the transport direction +R of the bundle of media M is bound. At the time when transport of the medium P from the conveyance path 60 to the stack portion 71 is completed, since the central portion C is shifted from the position of the binding unit 72 as illustrated in the right diagram of FIG. 5, the alignment portion 76 is moved in the −R direction and the central portion C of the bundle of media M is disposed at a position opposing the binding unit 72, as illustrated in the left diagram of FIG. 6. Furthermore, the abutment portion 77 is moved in the +R direction to abut on the upstream end E2 of the bundle of media M. The downstream end E1 and the upstream end E2 of the bundle of media M are aligned by the alignment portion 76 and the abutment portion 77, and the center portion C of the bundle of media M is bound by the binding unit 72.

Figure 6:
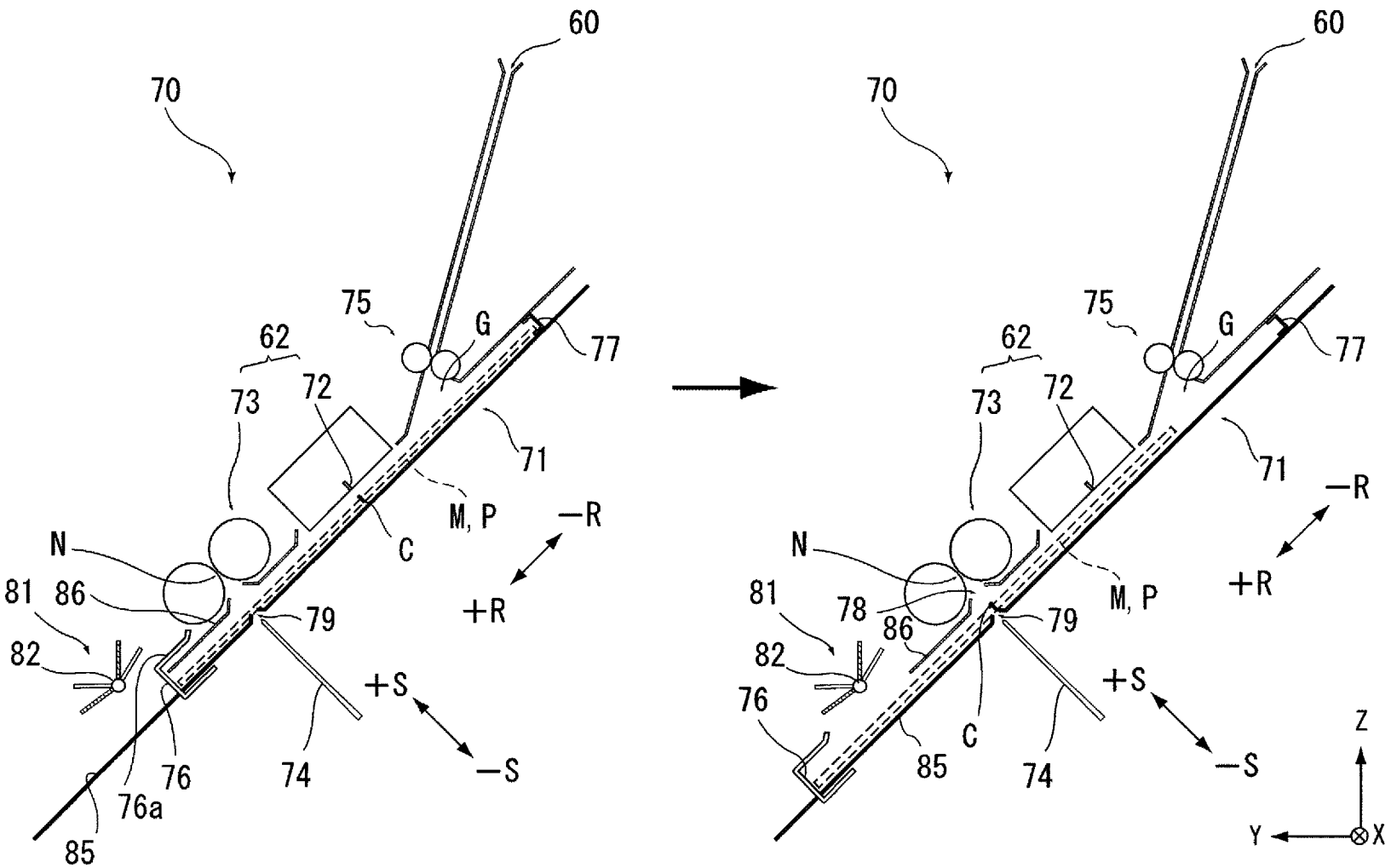
FIG. 6 is another diagram for explaining the flow of medium transport in the medium transport device.

When the bundle of media M is bound by the binding unit 72, the alignment portion 76 is moved in the +R direction as illustrated in the right diagram of FIG. 6, and the bundle of media M is moved such that the bound central portion C is disposed at a position opposing the nip position N of the folding roller pair 73. The bundle of media M can be moved in the +R direction by moving only the alignment portion 76 in the +R direction while maintaining a state in which the bundle of media M abuts on the alignment portion 76 by its own weight. The abutment portion 77 may be moved in the +R direction so as to maintain the state of being abutted on the upstream end E2 of the bundle of media M.

Subsequently, when the central portion C of the bundle of media M is disposed at a position opposing the nip position N of the folding roller pair 73, the blade 74 is advanced in the +S direction to bend the central portion C toward the folding roller pair 73 as illustrated in the left diagram of FIG. 7. The central portion C of the bent bundle of media M is moved toward the nip position N of the folding roller pair 73 through the approach path 78.

As illustrated in the right diagram of FIG. 7, when the central portion C of the bundle of media M is nipped by the folding roller pair 73, the folding roller pair 73 is rotated, and the bundle of media M is discharged toward the second tray 65 (FIG. 1) while being folded at the central portion C by the nip pressure of the folding roller pair 73.

After the central portion C is nipped by the folding roller pair 73, the alignment portion 76 moves in the +R direction, and returns to the state of the left diagram of FIG. 4 to prepare for the reception of the next medium P in the stack portion 71.

The transport path 60 can be provided with a crease forming mechanism that creases the central portion C of the medium P. By making a crease in the central portion C which is the folding position set by the folding roller pair 73, the bundle of media M can be easily folded at the central portion C.

About Control of Operation of Paddle by Control Unit

Subsequently, control of the operation of paddle 81 by the control unit 80 will be described.

The control unit 80 controls the operation of the paddle 81 according to the condition. In this embodiment, as the conditions to be used by the control unit 80, conditions relating to the medium P at the time of stacking the medium P, for example, the number of stacked media P previously stacked in the stack portion 71, a discharge amount of ink discharged to the medium P at the time of recording in the recording unit 2, whether recording on the medium P is double-sided recording or single-sided recording, and environmental conditions such as temperature and humidity when stacking the medium P are included, in addition to the type, rigidity, thickness, basis weight, and the like of the medium P.

When the paddle 81 is rotated under uniform conditions, the medium P moved by the rotation of the paddle 81 may hit the alignment portion 76 and is bounced off the alignment portion, or conversely, may not reach the alignment portion 76 depending on the conditions, which may result in inappropriate alignment.

In this embodiment, the downstream end E1 of the medium P can be appropriately abutted against the alignment portion 76 and the downstream end E1 can be aligned, by controlling the operation of the paddle 81 according to the condition by the control unit 80.

In this embodiment, although the configuration in which the paddle 81 is controlled by the control unit 80 is adopted, for example, when a configuration in which the entire recording system 1 can be controlled by the first control unit 25 provided in the recording unit 2 is adopted, the paddle 81 can be controlled by the first control unit 25.

The control unit 80 can change, for example, the rotation speed of the paddle 81 according to the condition. By changing the rotation speed of the paddle 81, the medium P can be moved toward the alignment portion 76 at a more appropriate speed.

The control unit 80 can switch driving and stopping of the paddle 81 according to the condition. By controlling the paddle 81 in this manner, the paddle 81 can be driven under the condition that assistance with paddle 81 is required, and the paddle 81 can be stopped under the condition that assistance with paddle 81 is not required, in aligning the medium P by allowing the medium P to be abutted against the alignment portion 76. Thus, the medium P can be more appropriately abutted against the alignment portion 76.

Hereinafter, control of the operation of the paddle 81 will be described by taking a specific example of the condition.

Control According to One Condition

As the conditions to be used by the control unit 80, any of the type of medium P to be stacked, the number of stacked media previously stacked in the stack portion 71, the stack height of the medium P previously stacked in the stack portion 71, and the discharge amount of ink (liquid) to the medium P transported by the feed roller pair can be used. In this embodiment, the medium P transported by the medium transport device 70 is a recorded medium to which ink is discharged for recording in the recording unit 2, and the discharge amount of ink is an amount of ink discharged to the medium P by the line head 20.

For example, with reference to a flowchart illustrated in FIG. 8, a case where the difference in basis weight of the stacked media P is used as the condition will be described.

The control unit 80 uses the basis weight of the medium P as the condition, and determines whether or not the basis weight of the medium P is equal to or greater than a predetermined weight (step S1). When the determination result in step S1 is YES, that is, when it is determined that the basis weight of the medium P is equal to or greater than the predetermined weight, the rotation speed of the paddle 81 is set to a first speed (step S2). When the determination result in step S1 is NO, that is, when it is determined that the basis weight of the medium P is less than the predetermined value, the rotation speed of the paddle 81 is set to a second speed slower than the first speed (step S3).

Since the medium having a large basis weight is heavy and difficult to move by the external force, when it is determined that the basis weight of the medium P is equal to or greater than the predetermined weight, the paddle 81 can be reliably moved in the +R direction to abut against the alignment portion 76 by setting the rotation speed of the paddle 81 to the first speed. On the other hand, when it is determined that the basis weight of the medium P is less than the predetermined weight (NO in step S1), since the rotation speed of the paddle 81 is set to the second speed slower than the first speed, the possibility that the light medium having a small basis weight vigorously hit the alignment portion 76 and is bounced off the alignment portion 76 can be reduced.

When the rotation speed of the paddle 81 is set to the second speed, the second speed may also be set to be zero, that is, the paddle 81 may also be in a state of being stopped.

Figure 9:
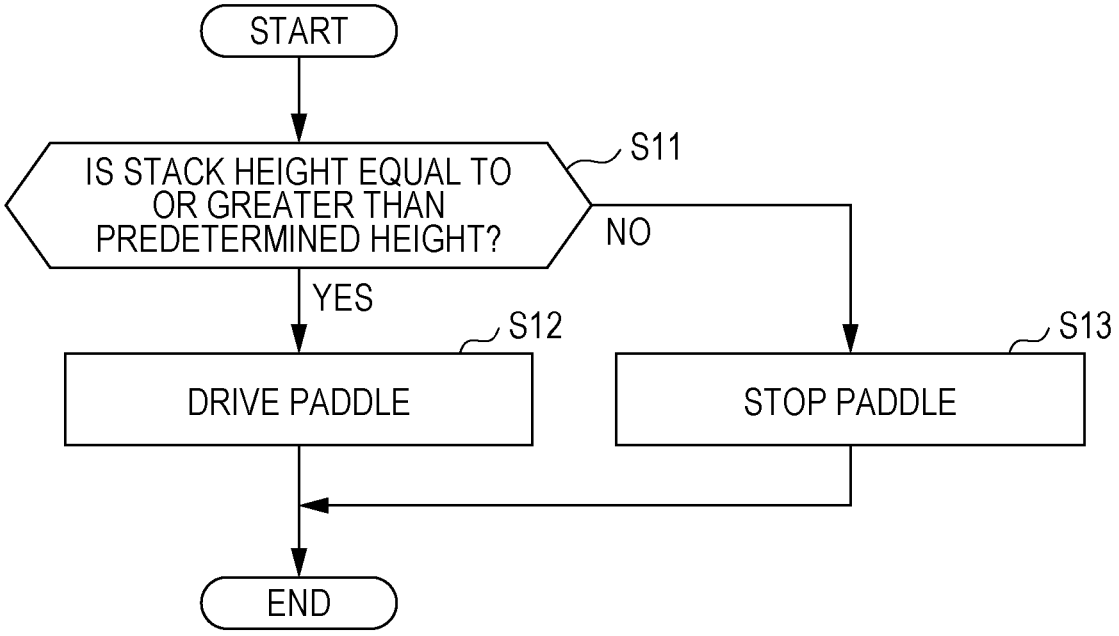
FIG. 9 is a flowchart illustrating a flow when controlling the operation of the paddle using stack height in a stack portion as the condition.

Next, with reference to the flowchart illustrated in FIG. 9, a case where the stack height of the medium P stacked in the stack portion 71 is used as the condition will be described.

The control unit 80 uses the stack height of the media P previously stacked in the stack portion 71 as the condition, and determines whether the stack height is equal to or greater than a predetermined height (step S11). When the determination result in step S11 is YES, that is, when it is determined that the stack height is equal to or greater than the predetermined height, the paddle 81 is driven (step S12). When the determination result in step S11 is NO, that is, when it is determined that the stack height is less than the predetermined height, the paddle 81 is stopped (step S13).

In a state in which the stack height of the medium P previously stacked in the stack portion 71 is low, that is, in the state where the space between the top medium P1 and the opposing surface 86 in the bundle of media M stacked in the stack portion 71 in FIG. 3 is wide, the subsequent medium to be sent next to the stack portion is easy to move downstream by its own weight. For that reason, when the paddle 81 is driven to assist the downstream movement of the medium P, there is a possibility that the medium P vigorously hit the alignment portion 76 and is bounced off the alignment portion 76 and the medium is not appropriately aligned.

On the other hand, when the stack height increases and the space between the top medium P1 and the opposing surface 86 narrows, there is a possibility that frictional resistance between the top medium P1 and the subsequent medium sent next to the stack portion 71 is likely to occur, and the subsequent medium is difficult to move toward the alignment portion 76, and the downstream end E1 does not reach the alignment portion 76 only by its own weight.

Accordingly, the paddle 81 is driven (step S12) when it is determined in step S11 that the stack height is equal to or greater than the predetermined height and the paddle 81 is stopped (step S13) when it is determined that the stack height is less than the predetermined height, thereby capable of avoiding the possibility that the medium P vigorously hits the or possibility that the downstream end E1 does not reach the alignment portion 76.

Figure 8:
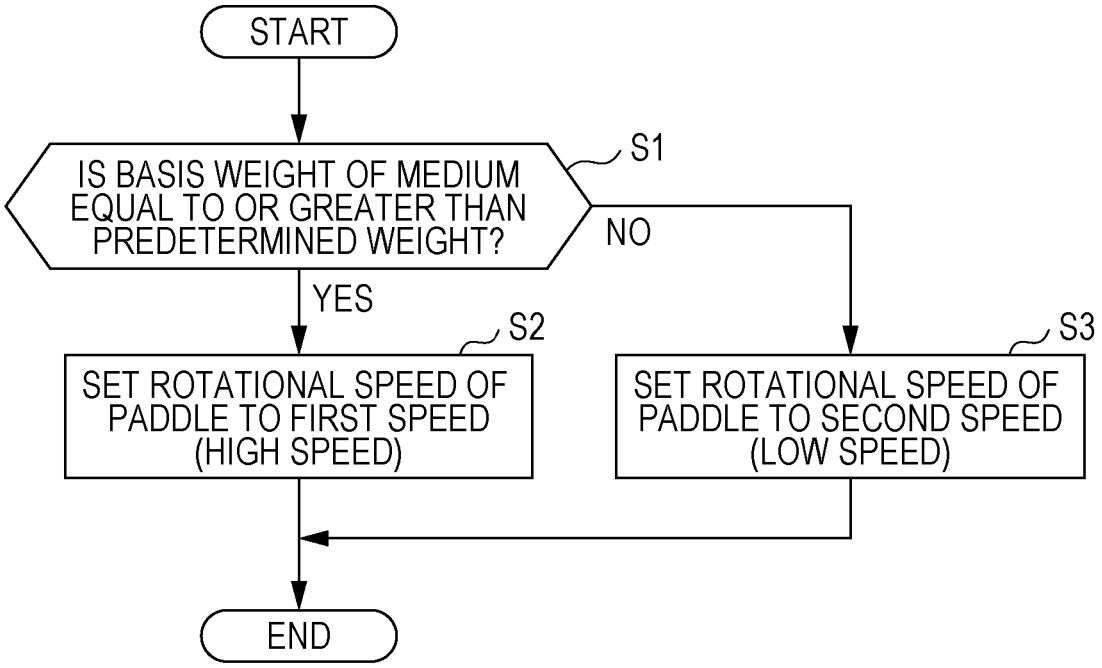
FIG. 8 is a flowchart illustrating a flow when controlling an operation of a paddle using a basis weight of the medium as a condition.

Similar to the flowchart illustrated in FIG. 8, the paddle 81 may be rotated at the first speed in step S12, and the paddle 81 may be rotated at the second speed slower than the first speed in step S13.

The number of stacked media previously stacked in the stack portion 71 corresponds to the height of the stack. Thus, a configuration in which the paddle 81 is driven when the number of stacked media in the stack portion 71 is equal to or greater than a predetermined number and the paddle 81 is stopped when the number of stacked media is smaller than the predetermined number may be adopted.

When the discharge amount of ink (liquid) to the medium P transported by the feed roller pair increases, the frictional resistance between the media increases, and thus the medium P is difficult to move toward the alignment portion 76 by its own weight. From this, a configuration, in which the paddle 81 is driven or rotated at the first speed when the discharge amount of ink (liquid) to the medium P is equal to or greater than a predetermined amount, or the paddle 81 is stopped or rotated at the second speed slower than the first speed when the discharge amount is less than the predetermined amount, can be adopted.

The paddle 81 can also be controlled according to the difference in thickness of the medium as the type of medium.

The medium becomes more difficult to move toward the alignment portion 76 as the thickness of the medium increases, and thus a configuration in which the paddle 81 is driven for the medium having a predetermined thickness or more can be adopted. For the medium having the predetermined thickness or more, the rotation speed of the paddle can be made faster than that of the medium having a thickness less than the predetermined thickness.

When the bundle of media M is subjected to saddle-stitching processing by the second processing unit 62 to form a booklet, the medium P to be finally stacked in the stack portion 71 is a cover and a back cover. For that reason, the medium P to be finally stacked in the stack portion 71 may be thicker than the other media stacked so far. In such a case, by controlling the paddle 81 according to the difference in thickness of the medium, the downstream end E1 can be aligned by allowing the downstream end E1 to be appropriately abutted against the alignment portion 76 even when the thickness of the stacked medium is partially different.

As described above, the operation of the paddle 81 can be controlled using, as the condition, any of the type of the medium to be stacked, the number of stacked media previously stacked in the stack portion 71, the stack height of the medium previously stacked in the stack portion 71, and the discharge amount of liquid to the medium when the medium transported by the feeding unit is the recorded medium to which the liquid is discharged for recording, and the downstream end E can be aligned by allowing the downstream end E to be appropriately abutted against the alignment portion 76.

The control unit 80 can determine whether to rotate the paddle 81, or can change not only the rotation speed when the paddle 81 is rotated but also the timing of starting the rotation.

Control According to Plurality of Conditions

The control unit 80 can be configured to control the paddle 81 using a plurality of conditions as the condition. By using the plurality of conditions, the operation of the paddle 81 can be controlled more appropriately.

The plurality of conditions includes two or more of the type of medium P to be stacked, temperature in an installation environment of the apparatus, humidity in the installation environment of the apparatus, the number of stacked media previously stacked in the stack portion 71, and the discharge amount of ink to the medium P.

For example, the control unit 80 uses, as the plurality of conditions, the type of medium and the number of stacked media previously stacked in the stack portion 71.

The control unit 80 has a threshold value T according to the type of the medium P as illustrated in Table 1 below, changes the threshold value T according to the type of the medium P, and controls the paddle 81 according to a flowchart illustrated in FIG. 10.

TABLE 1

| Type of medium | Threshold value T |
|---|---|
| first paper type | T1 |
| second paper type | T2 |
| third paper type | T3 |
| . | . |
| . | . |
| . | . |

Figure 10:
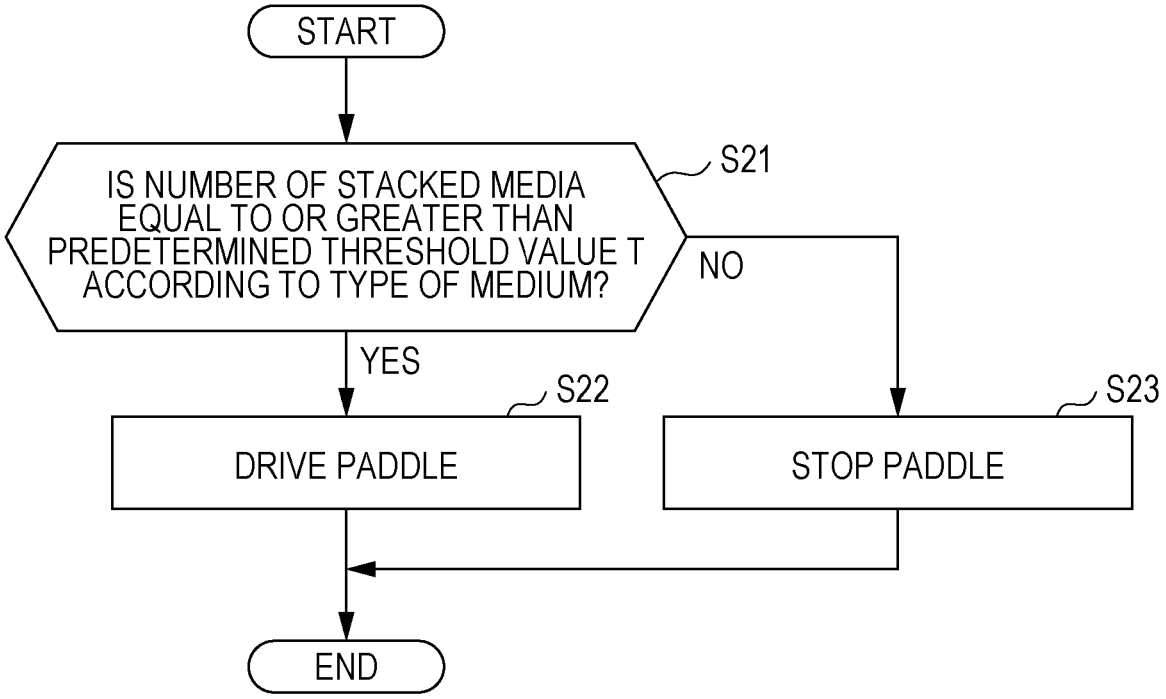
FIG. 10 is a flowchart illustrating a flow when controlling the operation of the paddle using the type of medium and the number of stacked media in the stack portion as the condition.

In FIG. 10, in step S21, the control unit 80 determines whether the number of stacked media is equal to or greater than a predetermined threshold value T according to the type of medium P. For example, when the medium P to be stacked is a first paper type, it is determined whether the number of stacked media is equal to or more than the threshold value T1.

When the determination result in step S21 is YES, that is, when it is determined that the number of stacked media is greater than or equal to the predetermined threshold value T according to the type of the medium P, the paddle 81 is driven in stacking the medium P (Step S22). When the determination result in step S21 is NO, that is, when it is determined that the number of stacked media is less than the predetermined threshold value T according to the type of the medium P, the paddle 81 is stopped in stacking the medium P (step S23).

As described above, in the stack portion 71 in which the medium is stacked in the inclined posture in which the downstream side in the transport direction is directed downward, the stacked medium P is easy to move toward the alignment portion 76 by its own weight when the number of stacked media previously stacked in the stack portion is small and is difficult to move when the number of stacked media increases.

Here, the number of stacked media that makes it difficult for the medium P to move in the stack portion 71 by its own weight changes according to the type of the medium P.

In this embodiment, as illustrated in the flowchart of FIG. 10, the control unit 80 switches driving and stopping of the paddle 81 using the threshold value T of the number of stacked media in consideration of the type of the media P, and thus the medium P can be more reliably aligned with the alignment portion 76.

The control unit 80 can use the discharge amount of ink to the medium P and the number of stacked media in the stack portion 71 as the plurality of conditions.

The control unit 80 has a predetermined threshold value t according to the discharge amount of ink to the medium P as illustrated in Table 2 below, changes the predetermined threshold value t according to the discharge amount of ink to the medium P, and controls the paddle 81 according to a flowchart illustrated in FIG. 11.

In the following, recording density (%) is used as a value corresponding to the discharge amount of ink to the medium P. The recording density (%) is a value that increases or decreases according to the ink discharge amount, and is a ratio of the total ink discharge amount (g) to the maximum ink ejection amount (g) to a recordable region of one sheet of paper. That is, recording density (%)=total ink discharge amount (g) to one sheet of paper/maximum ink ejection amount (g)×100. The maximum ink ejection amount (g) to the recordable region of one sheet of paper can be obtained from the maximum ink ejection amount (g) per unit area by the line head 20 provided in the recording unit 2.

The present disclosure is not limited to this, and the recording density (%) can also be a ratio of an area of the region where ink is discharged to the area of one sheet of paper.

TABLE 2

| Recording density (%) (discharge amount of ink to medium) | Threshold value t |
|---|---|
| 0 or more, less than 10 | t1 |
| 10 or more, less than 20 | t2 |
| 20 or more, less than 30 | t3 |
| . | . |
| . | . |
| . | . |

Figure 11:
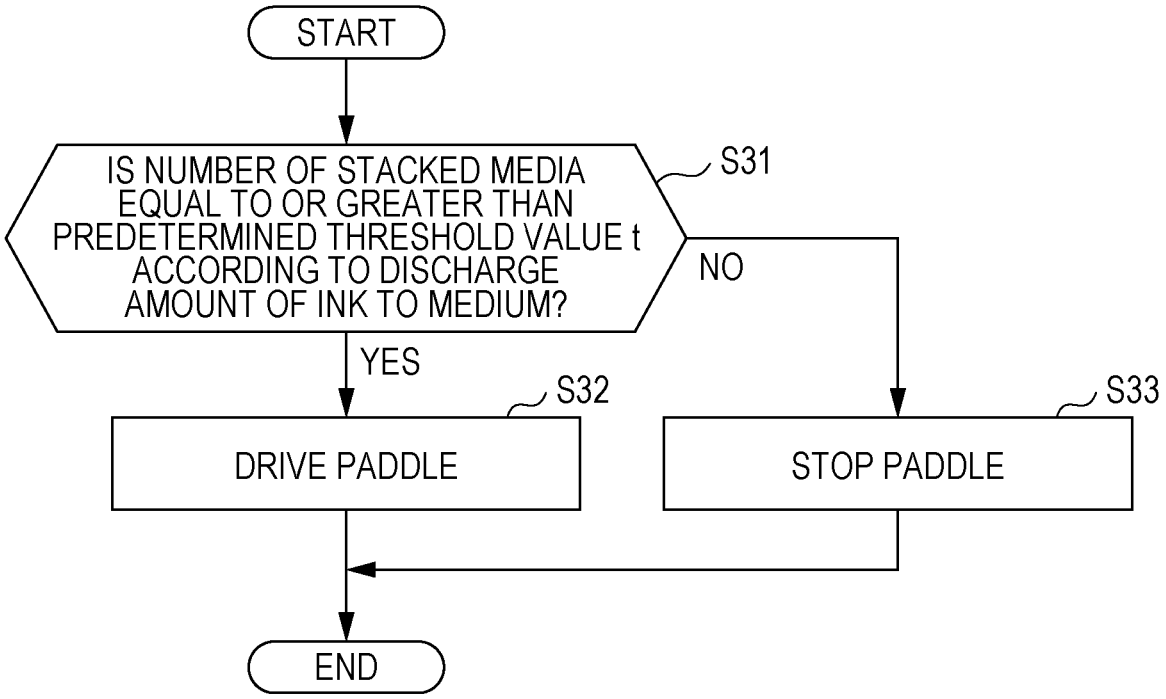
FIG. 11 is a flowchart illustrating a flow when controlling the operation of the paddle using a discharge amount of ink to the medium and the number of stacked media in the stack portion as the condition.

In FIG. 11, in step S31, the control unit 80 determines whether the number of stacked media is equal to or greater than the predetermined threshold value t according to the recording density of the medium P (discharge amount of ink to the medium P). For example, when the recording density on the stacked medium P is 0% or more and less than 10%, it is determined whether or not the number of stacked media is equal to or greater than a threshold value t1.

When the determination result in step S31 is YES, that is, when it is determined that the number of stacked media is greater than or equal to the predetermined threshold value t according to the recording density of the medium P, the paddle 81 is driven in stacking the medium P (Step S32). When the determination result in step S31 is NO, that is, when it is determined that the number of stacked media is less than the predetermined threshold value t according to the recording density of the medium P, the paddle 81 is stopped in stacking the medium P (step S33).

Although the medium P stacked in the stack portion 71 is easy to move toward the alignment portion 76 by its own weight when the number of stacked media previously stacked in the stack portion is small and is difficult to move when the number of stacked media increases, the number of stacked media that makes it difficult for the medium P to move by its own weight changes according to the frictional resistance between the media. The frictional resistance between the media changes according to the discharge amount of ink to the medium P. When the discharge amount of ink to the medium P is large, that is, the recording density is high, the frictional resistance between the media tends to be large, and when the discharge amount of ink to the medium P is small, that is, the recording density is low, the frictional resistance between the media tends to be small.

In this embodiment, as illustrated in the flowchart of FIG. 11, the control unit 80 switches driving and stopping of the paddle 81 using the threshold value t of the number of stacked media in consideration of the discharge amount of ink to the medium P, and thus the medium P can be more reliably aligned with the alignment portion 76.

The threshold value t of the number of stacked media according to the discharge amount of ink to the medium P is set lower as the discharge amount of ink to the medium P increases. That is, in Table 2, t1>t2>t3.

Since the frictional resistance between the media increases as the discharge amount of the ink to the medium P increases, even if the number of stacked media in the stack portion 71 is small, the medium P with the discharge amount of ink to the medium P is large is difficult to move toward the alignment portion 76 by its own weight. By setting the threshold value t to be lower as the discharge amount of ink to the medium P increases, the possibility of the abutment failure of the medium P against the alignment portion 76 can be suppressed more reliably.

When the medium P to be stacked is in a state of being susceptible to curling, the threshold value t of the number of stacked media according to the ink discharge amount may be set to a low value. For example, if there is a difference between the discharge amount of ink to the first surface and the opposite second surface of the medium, the medium tends to curl. Accordingly, when there is a difference between the discharge amount of ink to the first surface and the second surface of the medium, the threshold value t may be set low.

The control unit 80 can make the rotation speed of the paddle 81 when the discharge amount of ink to the medium P is the first discharge amount faster than the rotation speed of the paddle 81 when the discharge amount of ink to the medium P is the second discharge amount smaller than the first discharge amount.

As described above, as the discharge amount of ink to the medium P increases, the frictional resistance between the media increases. Accordingly, by making the rotation speed of the paddle 81 when the discharge amount of ink to the medium P is the first discharge amount faster than the rotation speed of the paddle 81 when the discharge amount of ink to the medium P is the second discharge amount smaller than the first discharge amount, it is possible to reliably move the medium P, which is difficult to move due to a large amount of ink discharge, by the paddle 81.

The control unit 80 can control the paddle 81 and the feed roller pair 75 so as to make the circumferential speed of the paddle 81 faster than the circumferential speed of the driving roller 75*a* of the feed roller pair 75.

When it is necessary to rotate the paddle 81 in a state where the medium P is nipped by the feed roller pair 75, if the circumferential speed of the paddle 81 is slower than the circumferential speed of the feed roller pair 75, there is a possibility of the medium P being buckled between the paddle 81 and the feed roller pair 75. By making the circumferential speed of the paddle 81 faster than the circumferential speed of the driving roller, the possibility of the medium P being buckled between the paddle 81 and the feed roller pair 75 can be reduced.

The control unit 80 drives the paddle 81 after the upstream end E2 of the stacked medium P passes the position where the stacked medium receives a feeding force from the feed roller pair 75 illustrated in FIG. 3, that is, drives the paddle 81 after the upstream end E2 of the medium P comes out of the nip of the feed roller pair 75, thereby capable of avoiding the possibility of the medium P being buckled between the feed roller pair 75 and the paddle 81.

Next, description will be made on control of the paddle 81, which is performed by the control unit 80 using the type of medium, the temperature and humidity in the installation environment of the apparatus, the discharge amount of ink to the medium P, and the number of stacked media in the stack portion 71, as the plurality of conditions.

For each of a first paper type, a second paper type, and a third paper type having different basis weights as media types, the control unit 80 includes three control tables (first to third tables) according to the discharge amount of ink (recording density), temperature in a dry environment, humidity in a dry environment, and the number of stacked media in the stack portion 71. The basis weights of the first paper type, the second paper type, and the third paper type are, for example, 60 g/m$^2$ or more and less than 80 g/m$^2$ for the first paper type, 80 g/m$^2$ or more and less than 100 g/m$^2$, for the second paper type, and 100 g/m$^2$ or more for the third paper type.

Figure 12:
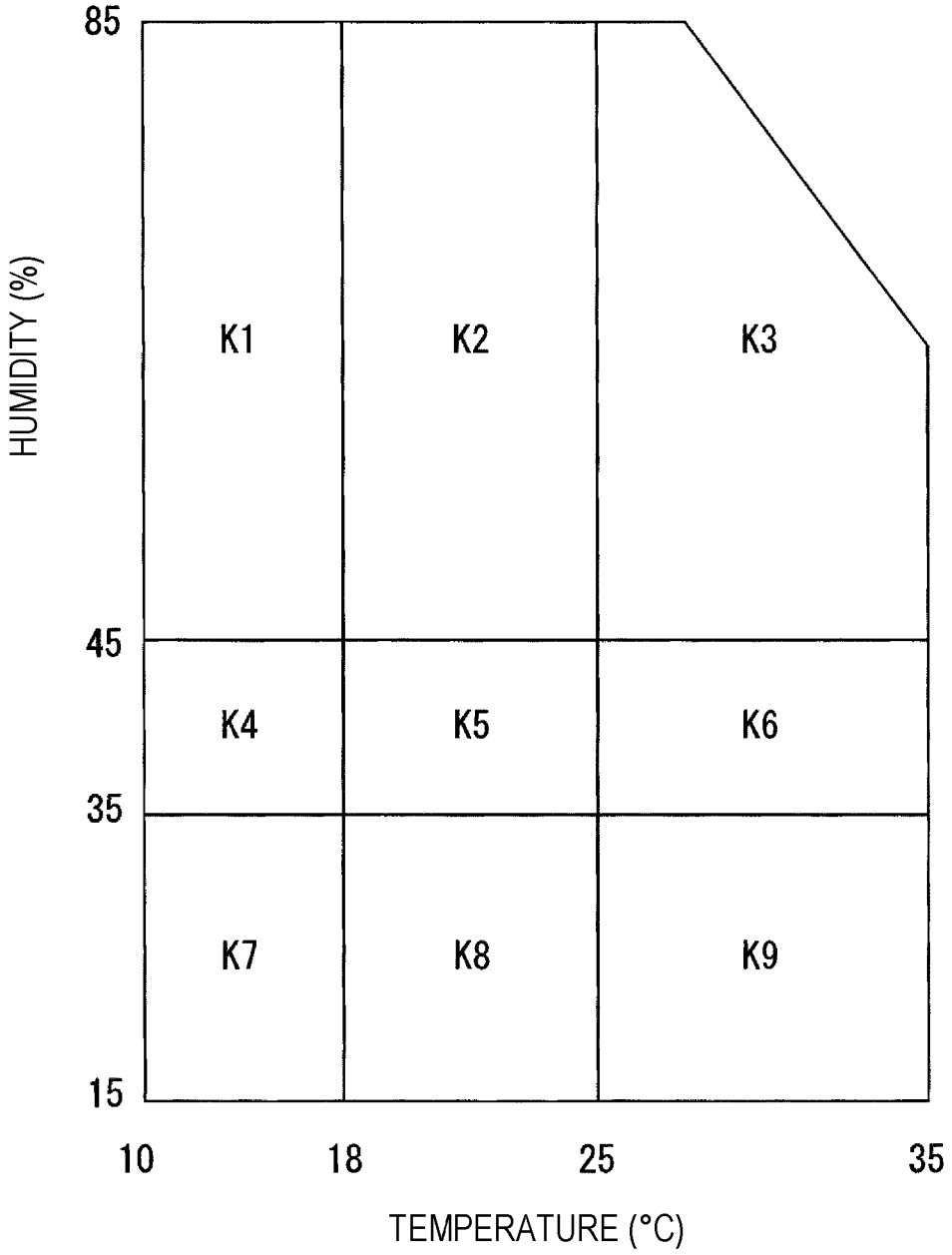
FIG. 12 is a graph illustrating classifications according to a relationship between temperature and humidity in an installation environment of an apparatus.

As the temperature and humidity of the installation environment of the apparatus, the temperature and humidity of the room where the recording system 1 is installed can be used. A humidity measurement unit and a temperature measurement unit (not illustrated) may be provided in the recording unit 2 and the measurement results of the measurement units may be used. Although either one of temperature and humidity may be used, in this embodiment, the installation environment of the apparatus is divided into nine sections K1 to K9 as illustrated in FIG. 12 according to the relationship between temperature and humidity in a temperature and humidity environment.

Table 3 illustrates an example of a first table which is a control table for the first paper type. Table 4 illustrates an example of a second table which is a control table for the second paper type. Table 5 illustrates an example of a third table which is a control table for the paper type.

The first table (Table 3), the second table (Table 4), and the third table (Table 5) represent threshold values for the number of stacked media for determining whether to drive the paddle 81, which are determined according to classification of the installation environment of the apparatus and the discharge amount of ink (recording density), and the rotation speed of the paddle 81 when driving the paddle 81.

In the first table (Table 3), the second table (Table 4), and the third table (Table 5), the rotation speed of the paddle is divided into, for example, three stages of low speed, medium speed, and high speed. The low speed is a rotation speed slower than the rotation speed of the feed roller pair 75, the medium speed is equal to the rotation speed of the feed roller pair 75, and the high speed is a rotation speed faster than the rotation speed of the feed roller pair 75. The degree of low speed and high speed can be further finely divided and controlled.

TABLE 3

First table

| | Environment | | | | | |
|---|---|---|---|---|---|---|
| | Classification K1 | | Classification K2 | | Classification K3 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 18 | low | 16 | low |
| 10 or more, less than 20 | 18 | low | 16 | low | 14 | low |
| 20 or more, less than 30 | 16 | low | 14 | medium | 12 | medium |
| 30 or more, less than 40 | 14 | medium | 12 | medium | 10 | medium |
| 40 or more, less than 50 | 12 | medium | 10 | medium | 5 | medium |
| 50 or more, less than 60 | 10 | medium | 5 | high | 0 | high |
| 60 or more, less than 70 | 5 | high | 0 | high | 0 | high |
| 70 or more, less than 80 | 0 | high | 0 | high | 0 | high |
| 80 or more, less than 90 | 0 | high | 0 | high | 0 | high |
| 90 or more, less than 100 | 0 | high | 0 | high | 0 | high |
| 100 or more | 0 | high | 0 | high | 0 | high |

| | Environment | | | | | |
|---|---|---|---|---|---|---|
| | Classification K4 | | Classification K5 | | Classification K6 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 20 secs | low | 20 secs | low | 20 secs | low |
| 20 or more, less than 30 | 18 | low | 20 secs | low | 20 secs | low |
| 30 or more, less than 40 | 16 | low | 18 | low | 20 secs | low |
| 40 or more, less than 50 | 14 | medium | 16 | low | 18 | low |
| 50 or more, less than 60 | 12 | medium | 14 | medium | 16 | low |
| 60 or more, less than 70 | 10 | medium | 12 | medium | 14 | medium |
| 70 or more, less than 80 | 5 | high | 10 | medium | 12 | medium |
| 80 or more, less than 90 | 0 | high | 5 | high | 10 | medium |
| 90 or more, less than 100 | 0 | high | 0 | high | 5 | high |
| 100 or more | 0 | high | 0 | high | 0 | high |

TABLE 3-continued

| First table | | | | | | |
|---|---|---|---|---|---|---|
| | Environment | | | | | |
| | Classification K7 | | Classification K8 | | Classification K9 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 20 secs | low | 20 secs | low | 20 secs | low |
| 20 or more, less than 30 | 20 secs | low | 20 secs | low | 20 secs | low |
| 30 or more, less than 40 | 20 secs | low | 20 secs | low | 20 secs | low |
| 40 or more, less than 50 | 18 | low | 18 | low | 18 | low |
| 50 or more, less than 60 | 16 | low | 16 | low | 16 | low |
| 60 or more, less than 70 | 14 | medium | 14 | low | 14 | low |
| 70 or more, less than 80 | 12 | medium | 12 | medium | 12 | low |
| 80 or more, less than 90 | 10 | medium | 10 | medium | 10 | medium |
| 90 or more, less than 100 | 5 | high | 5 | medium | 5 | medium |
| 100 or more | 0 | high | 0 | high | 0 | medium |

TABLE 4

| Second table | | | | | | |
|---|---|---|---|---|---|---|
| | Environment | | | | | |
| | Classification K1 | | Classification K2 | | Classification K3 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 18 | low | 16 | low | 14 | low |
| 10 or more, less than 20 | 16 | low | 14 | low | 12 | low |
| 20 or more, less than 30 | 14 | medium | 12 | low | 10 | low |
| 30 or more, less than 40 | 12 | medium | 10 | medium | 5 | low |
| 40 or more, less than 50 | 10 | medium | 5 | medium | 0 | medium |
| 50 or more, less than 60 | 5 | high | 0 | medium | 0 | medium |
| 60 or more, less than 70 | 0 | high | 0 | high | 0 | medium |
| 70 or more, less than 80 | 0 | high | 0 | high | 0 | high |
| 80 or more, less than 90 | 0 | high | 0 | high | 0 | high |
| 90 or more, less than 100 | 0 | high | 0 | high | 0 | high |
| 100 or more | 0 | high | 0 | high | 0 | high |
| | Environment | | | | | |
| | Classification K4 | | Classification K5 | | Classification K6 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 18 | low | 20 secs | low | 20 secs | low |
| 20 or more, less than 30 | 16 | low | 18 | low | 20 secs | low |
| 30 or more, less than 40 | 14 | medium | 16 | low | 18 | low |
| 40 or more, less than 50 | 12 | medium | 14 | medium | 16 | low |
| 50 or more, less than 60 | 10 | medium | 12 | medium | 14 | medium |
| 60 or more, less than 70 | 5 | high | 10 | medium | 12 | medium |
| 70 or more, less than 80 | 0 | high | 5 | high | 10 | medium |
| 80 or more, less than 90 | 0 | high | 0 | high | 5 | high |
| 90 or more, less than 100 | 0 | high | 0 | high | 0 | high |
| 100 or more | 0 | high | 0 | high | 0 | high |
| | Environment | | | | | |
| | Classification K7 | | Classification K8 | | Classification K9 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 20 secs | low | 20 secs | low | 20 secs | low |

TABLE 4-continued

| Second table | | | | | | |
|---|---|---|---|---|---|---|
| 20 or more, less than 30 | 20 secs | low | 20 secs | low | 20 secs | low |
| 30 or more, less than 40 | 18 | low | 20 secs | low | 20 secs | low |
| 40 or more, less than 50 | 16 | medium | 18 | low | 18 | low |
| 50 or more, less than 60 | 14 | medium | 16 | medium | 16 | low |
| 60 or more, less than 70 | 12 | medium | 14 | medium | 14 | medium |
| 70 or more, less than 80 | 10 | high | 12 | medium | 12 | medium |
| 80 or more, less than 90 | 5 | high | 10 | high | 10 | medium |
| 90 or more, less than 100 | 0 | high | 5 | high | 5 | high |
| 100 or more | 0 | high | 0 | high | 0 | high |

TABLE 5

Third table

| | Environment | | | | | |
|---|---|---|---|---|---|---|
| | Classification K1 | | Classification K2 | | Classification K3 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 20 secs | medium | 20 secs | low | 20 secs | low |
| 20 or more, less than 30 | 18 | medium | 20 secs | medium | 18 | low |
| 30 or more, less than 40 | 16 | medium | 18 | medium | 16 | medium |
| 40 or more, less than 50 | 14 | high | 16 | medium | 14 | medium |
| 50 or more, less than 60 | 12 | high | 14 | high | 12 | medium |
| 60 or more, less than 70 | 10 | high | 12 | high | 10 | high |
| 70 or more, less than 80 | 5 | high | 10 | high | 5 | high |
| 80 or more, less than 90 | 0 | high | 5 | high | 0 | high |
| 90 or more, less than 100 | 0 | high | 0 | high | 0 | high |
| 100 or more | 0 | high | 0 | high | 0 | high |

| | Environment | | | | | |
|---|---|---|---|---|---|---|
| | Classification K4 | | Classification K5 | | Classification K6 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 20 secs | low | 20 secs | low | 20 secs | low |
| 20 or more, less than 30 | 20 secs | low | 20 secs | low | 20 secs | low |
| 30 or more, less than 40 | 18 | medium | 18 | low | 18 | low |
| 40 or more, less than 50 | 16 | medium | 16 | medium | 16 | low |
| 50 or more, less than 60 | 14 | medium | 14 | medium | 14 | medium |
| 60 or more, less than 70 | 12 | high | 12 | medium | 12 | medium |
| 70 or more, less than 80 | 10 | high | 10 | high | 10 | medium |
| 80 or more, less than 90 | 5 | high | 5 | high | 5 | high |
| 90 or more, less than 100 | 0 | high | 0 | high | 0 | high |
| 100 or more | 0 | high | 0 | high | 0 | high |

| | Environment | | | | | |
|---|---|---|---|---|---|---|
| | Classification K7 | | Classification K8 | | Classification K9 | |
| Recording density (%) | Threshold value for the number of stacked media | Paddle speed | Threshold value for the number of stacked media | Paddle speed | Threshold value for the number of stacked media | Paddle speed |
| 0 or more, less than 10 | 20 secs | low | 20 secs | low | 20 secs | low |
| 10 or more, less than 20 | 20 secs | low | 20 secs | low | 20 secs | low |
| 20 or more, less than 30 | 20 secs | low | 20 secs | low | 20 secs | low |
| 30 or more, less than 40 | 18 | low | 18 | low | 18 | low |
| 40 or more, less than 50 | 16 | medium | 16 | low | 16 | low |
| 50 or more, less than 60 | 14 | medium | 14 | medium | 14 | low |
| 60 or more, less than 70 | 12 | medium | 12 | medium | 12 | medium |
| 70 or more, less than 80 | 10 | high | 10 | medium | 10 | medium |
| 80 or more, less than 90 | 5 | high | 5 | high | 5 | medium |
| 90 or more, less than 100 | 0 | high | 0 | high | 0 | high |
| 100 or more | 0 | high | 0 | high | 0 | high |

Figure 13:
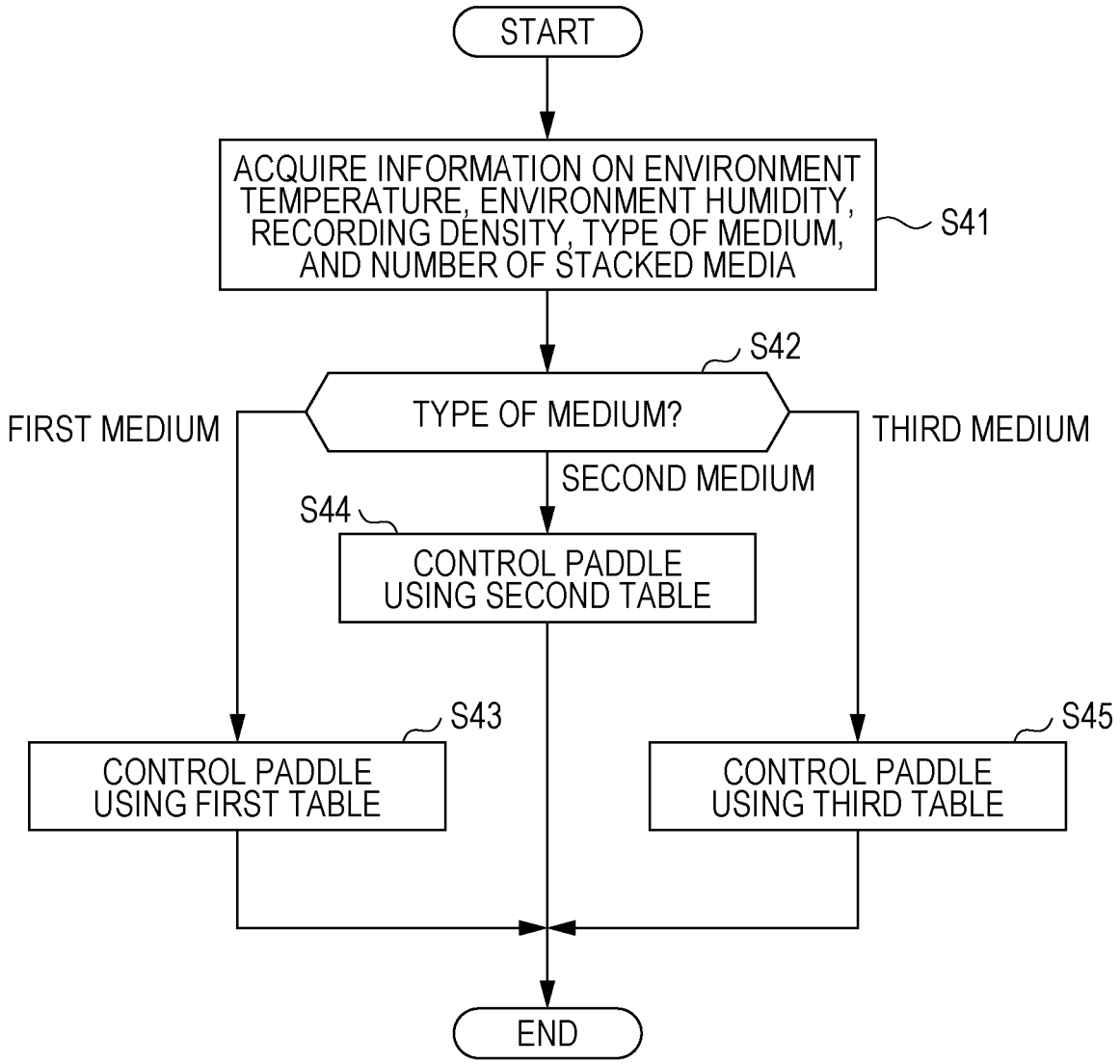
FIG. 13 is a flowchart illustrating a flow when controlling the operation of the paddle using the temperature and humidity in the installation environment of the apparatus, the type of medium, the discharge amount of ink to the medium, and the number of stacked media in the stack portion as the condition.

The control unit 80 controls the paddle 81 according to a flowchart illustrated in FIG. 13. In step S41, the control unit 80 acquires information on the temperature and humidity in the installation environment of the apparatus, the recording density, the number of stacked media in the stack portion 71, and the type of medium.

Subsequently, the process proceeds to step S42, it is determined whether the type of medium is the first medium, the second medium, or the third medium. When it is determined in step S42 that the type of medium is the first medium, the process proceeds to step S43, and the paddle 81 is controlled using the first table (Table 3). When it is determined in step S42 that the type of medium is the second medium, the process proceeds to step S44, and the paddle 81 is controlled using the second table (Table 4). When it is determined in step S42 that the type of medium is the third medium, the process proceeds to step S45, and the paddle 81 is controlled using the third table (Table 5).

As described above, the control unit 80 can control the paddle 81 more appropriately, and thus can move the medium P toward the alignment portion 76 more appropriately by using, as the conditions, the type of medium, the temperature and humidity in the installation environment of the apparatus, the discharge amount of ink to the medium P, and the number of stacked media in the stack portion 71 and controlling the paddle 81 based on the plurality of conditions.

About Paddle Configuration

As illustrated in FIG. 2, the paddle 81 is provided with a first paddle 81*a* and a second paddle 81*b* which are provided at intervals in the width direction (X-axis direction) intersecting the transport direction (+R direction). In this embodiment, two first paddles 81*a* are provided at intervals in the center in the width direction, and two second paddles 81*b* are provided on both sides of the first paddles.

The first paddle 81*a* and the second paddle 81*b* are disposed such that the phases in the circumferential direction of the rotation shaft 82 are different from each other as illustrated in FIG. 3.

Although the paddle 81 sends the medium P in the transport direction +R by rotating while being in contact with the medium P, a contact angle of the rotating paddle 81 with respect to the medium P changes, and thus a wave (velocity unevenness) may be generated in the transport speed of the medium P.

In this embodiment, since two types of paddles (first paddle 81*a* and second paddle 81*b*) whose phases in the circumferential direction of the rotation shaft 82 are different from each other are provided, the wave of the transport speed of the medium P generated by the first paddle 81*a* and the wave of the transport speed generated by the second paddle 81*b* are offset. Accordingly, the transport speed of the medium P can be made uniform as a whole.

For example, the first paddle 81*a* and the second paddle 81*b* may be configured such that one first paddle 81*a* is provided at the center in the width direction and the second paddle 81*b* is provided on both sides thereof. It is also possible to provide a third paddle different in phase in the circumferential direction from both of the first paddle 81*a* and the second paddle 81*b*. The third paddle can be provided, for example, further outside in the width direction with respect to the second paddle 81*b*.

A device obtained by omitting the saddle-stitching function from the second unit 6 as a medium processing apparatus in the first embodiment can be regarded as the medium transport device 70. Also, an apparatus obtained by omitting the recording function from the recording system 1 can be regarded as the medium transport device 70 or the medium processing apparatus that performs saddle-stitching processing on the medium.

The medium transport device 70 can also be employed in a medium processing apparatus that performs not only saddle-stitching processing but also end-stitching processing and punching processing on a bundle of media having aligned ends.

Further, it is needless to say that the present disclosure is not limited to the embodiment described above and various modifications may be made thereto within the scope of the disclosure described in the claims, and various modifications are also included in the scope of the present disclosure.

What is claimed is:

1. A medium transport device comprising:

a feeder that transports a medium;

a stacker that receives the medium transported by the feeder between a support surface for supporting the medium in an inclined posture in which a downstream side in a transport direction is directed downward and an opposing surface opposing the support surface and stacks the medium;

an aligner that aligns a downstream end of the medium stacked in the stacker;

a paddle that is provided between the feeder and the aligner in the transport direction and moves the medium toward the aligner by rotating while being in contact with the medium; and a controller that controls an operation of the paddle, wherein the controller controls the operation of the paddle according to a condition, wherein the controller switches between driving and stopping of the paddle according to the condition.

2. The medium transport device according to claim 1, wherein as the condition, any of a type of the medium to be stacked, the number of stacked media previously stacked in the stacker, a stack height of the media previously stacked in the stacker, and a discharge amount of liquid to the medium when the medium transported by the feeder is a recorded medium to which the liquid is discharged for recording is used.

3. The medium transport device according to claim 2, wherein the controller changes a rotation start timing of the paddle according to the condition.

4. The medium transport device according to claim 1, wherein the controller controls the operation of the paddle according to a basis weight of the medium.

5. The medium transport device according to claim 1, wherein the controller drives the paddle after an upstream end of the stacked medium passes a position where the medium to be stacked receives a feeding force from the feeding unit.

6. The medium transport device according to claim 1, wherein the paddle includes a first paddle provided on a rotation shaft intersecting the transport direction and second paddles provided on the rotation shaft and disposed on both sides of the first paddle, and the first paddle and the second paddles are disposed such that phases in a circumferential direction of a rotation shaft are different from each other.

7. A medium processing apparatus comprising:

the medium transport device according to claim 1; and processor that performs processing on the medium stacked in the stacker.

8. The medium processing apparatus according to claim 7, wherein the processor includes a binder that binds the medium and a folder that folds the medium at a binding position by the binding unit.

9. The medium transport device according to claim 1, wherein as the condition, a discharge amount of liquid to the medium when the medium transported by the feeding unit is a recorded medium to which the liquid is discharged for recording is used.

10. A medium transport device comprising:

a feeder that transports a medium;

a stacker that receives the medium transported by the feeder between a support surface for supporting the medium in an inclined posture in which a downstream side in a transport direction is directed downward and an opposing surface opposing the support surface and stacks the medium;

an aligner that aligns a downstream end of the medium stacked in the stacker;

a paddle that is provided between the feeder and the aligner in the transport direction and moves the medium toward the aligner by rotating while being in contact with the medium; and a controller that controls an operation of the paddle, wherein the controller controls the operation of the paddle according to a condition, wherein the controller uses a plurality of conditions as the condition.

11. The medium transport device according to claim 10, wherein the plurality of conditions includes two or more of a type of the medium to be stacked, a temperature in an installation environment of the device, a humidity in the installation environment, the number of stacked media previously stacked in the stacker, and a discharge amount of liquid to the medium when the medium transported by the feeder is a recorded medium to which the liquid is discharged for recording.

12. The medium transport device according to claim 11, wherein the controller uses the type of the medium and the number of stacked media previously stacked in the stacker as the plurality of conditions, stops the paddle in stacking the medium when the number of stacked media is less than a predetermined threshold value according to the type of the medium, and drives the paddle in stacking the medium when the number of stacked media is equal to or greater than the predetermined threshold value according to the type of the medium.

13. The medium transport device according to claim 11, wherein the controller uses the discharge amount of the liquid to the medium and the number of stacked media in the stacker as the plurality of conditions, stops the paddle in stacking the medium when the number of stacked media is less than a predetermined threshold value according to the discharge amount of the liquid to the medium, and drives the paddle in stacking the medium when the number of stacked media is equal to or greater than the predetermined threshold value according to the discharge amount of the liquid to the medium.

14. The medium transport device according to claim 13, wherein the threshold value of the number of stacked media is set to be lower as the discharge amount of the liquid to the medium increases.

15. The medium transport device according to claim 13, wherein the controller makes a rotation speed of the paddle when the discharge amount of the liquid to the medium is a first discharge amount faster than the rotation speed when the discharge amount of the liquid to the medium is a second discharge amount smaller than the first discharge amount.

16. The medium transport device according to claim 13, wherein the controller sets the threshold value according to a difference between the discharge amount of the liquid to a first surface of the medium and the discharge amount of the liquid to a second surface opposite to the first surface.

17. The medium transport device according to claim 1, wherein the controller changes a rotation speed of the paddle according to the condition.

18. A medium transport device comprising:

a feeder that transports a medium;

a stacker that receives the medium transported by the feeder between a support surface for supporting the medium in an inclined posture in which a downstream side in a transport direction is directed downward and an opposing surface opposing the support surface and stacks the medium;

an aligner that aligns a downstream end of the medium stacked in the stacker;

a paddle that is provided between the feeder and the aligner in the transport direction and moves the medium toward the aligner by rotating while being in contact with the medium; and a controller that controls an operation of the paddle, wherein the controller controls the operation of the paddle according to a condition, wherein the feeder is a feed roller pair including a driving roller controlled to rotate by the controller and a driven roller driven to rotate following the rotation of the driving roller, and the controller makes a circumferential speed of the paddle faster than a circumferential speed of the driving roller.

* * * * *